US009329552B2

(12) United States Patent
Haruyama

(10) Patent No.: US 9,329,552 B2
(45) Date of Patent: May 3, 2016

(54) MEDIUM TRANSPORTATION APPARATUS AND IMAGE FORMING APPARATUS

(71) Applicant: OKI DATA CORPORATION, Tokyo (JP)

(72) Inventor: Masahiro Haruyama, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/631,941

(22) Filed: Feb. 26, 2015

(65) Prior Publication Data

US 2015/0241832 A1 Aug. 27, 2015

(30) Foreign Application Priority Data

Feb. 27, 2014 (JP) ..... 2014-036493

(51) Int. Cl.
*G03G 15/00* (2006.01)
*B65H 29/58* (2006.01)

(52) U.S. Cl.
CPC ..... *G03G 15/6529* (2013.01); *B65H 29/58* (2013.01); *G03G 15/6552* (2013.01); *G03G 2215/00675* (2013.01); *G03G 2215/00679* (2013.01)

(58) Field of Classification Search
CPC ..... B65H 5/36; B65H 29/58; B65H 29/60; B65H 2404/63; B65H 2404/632; G03G 15/6529; G03G 15/6552; G03G 2215/00675; G03G 2215/00679
USPC ..... 271/303
See application file for complete search history.

(56) References Cited

U.S. PATENT DOCUMENTS 8,340,566 B2 * 12/2012 Jeong ..... B65H 5/36 271/301
8,387,980 B2 * 3/2013 Kang ..... B41J 13/009 271/225
2005/0035540 A1 * 2/2005 Carter ..... B65H 7/02 271/303
2012/0146284 A1 * 6/2012 Dobrindt ..... B65H 29/58 271/225
2013/0127111 A1 * 5/2013 Ohnishi ..... G03G 15/6529 271/303
2013/0156479 A1 * 6/2013 Nara ..... B65H 29/58 399/401
2014/0048385 A1 * 2/2014 Agier ..... B07C 3/065 198/368
2014/0159303 A1 * 6/2014 Suzuki ..... G03G 15/234 271/225

FOREIGN PATENT DOCUMENTS

JP 2006-213518 A 8/2006

* cited by examiner

*Primary Examiner* — David H Bollinger
(74) *Attorney, Agent, or Firm* — Kubotera & Associates, LLC

(57) ABSTRACT

A medium transportation apparatus includes a fixed member fixed to an apparatus main body, and a switching guide for guiding a medium. The switching guide is disposed to be freely rotatable relative to the apparatus main body, and to be freely switched between a first guiding position and a second guiding position. The switching guide includes a medium guiding portion and a first engaging portion integrally formed with the medium guiding portion. The fixed member includes a second engaging portion for engaging with the first engaging portion. When the switching guide is situated at the first guiding position, the first engaging portion engages with the second engaging portion.

19 Claims, 21 Drawing Sheets

MEDIUM TRANSPORTATION APPARATUS AND IMAGE FORMING APPARATUS

BACKGROUND OF THE INVENTION AND RELATED ART STATEMENT

The present invention relates to a medium transportation apparatus and an image forming apparatus.

In a conventional image forming apparatus using an electro-photography method such as a printer, a copier, a facsimile, a multi function product, and the like, there are provided a photosensitive drum; a charging roller for uniformly charging a surface of the photosensitive drum; and an LED (Light Emitting Diode) head for forming a static latent image on the surface of the photosensitive drum thus charged. The conventional image forming apparatus further includes a developing roller for developing the static latent image to form a toner image; a transfer roller for transferring the toner image to a sheet as a medium; and a fixing device for fixing the toner image to the sheet.

Patent Reference has disclosed a printer as such the conventional image forming apparatus. The printer disclosed in Patent Reference is configured to sort the sheet with the image formed thereon, or perform a post processing such as stapling on the sheet. In the printer disclosed in Patent Reference, a switching guide is provided in a medium transportation apparatus for transporting the sheet such that the switching guide is capable of rotating around a rotational axis thereof. When the switching guide is rotated, it is possible to switch a route for guiding the sheet, that is, a guiding route.

Patent Reference: Japanese Patent Publication No. 2006-213518

In the conventional image forming apparatus disclosed in Patent Reference, the switching guide tends to have an excessive size in a longitudinal direction thereof. Accordingly, the switching guide tends to be curved or deformed. When the switching guide is deformed, it is difficult to stably guide the sheet when the switching guide switches the guiding route.

In view of the problems of the conventional image forming apparatus, an object of the present invention is to provide a medium transportation apparatus and an image forming apparatus capable of solving the problems of the conventional image forming apparatus. In the medium transportation apparatus and the image forming apparatus, it is possible to stably guide a sheet when a switching guide switches the guiding route.

Further objects and advantages of the invention will be apparent from the following description of the invention.

SUMMARY OF THE INVENTION

In order to attain the objects described above, according to an aspect of the present invention, a medium transportation apparatus includes a fixed member fixed to an apparatus main body, and a switching guide for guiding a medium. The switching guide is disposed to be freely rotatable relative to the apparatus main body, and to be freely switched between a first guiding position and a second guiding position.

According to the aspect of the present invention, the switching guide includes a medium guiding portion and a first engaging portion integrally formed with the medium guiding portion. The fixed member includes a second engaging portion for engaging with the first engaging portion. When the switching guide is situated at the first guiding position, the first engaging portion engages with the second engaging portion.

According to the aspect of the present invention, the medium transportation apparatus includes the fixed member fixed to the apparatus main body, and the switching guide for guiding a medium. The switching guide is disposed to be freely rotatable relative to the apparatus main body, and to be freely switched between the first guiding position and the second guiding position.

According to the aspect of the present invention, the switching guide includes the medium guiding portion and the first engaging portion integrally formed with the medium guiding portion. The fixed member includes the second engaging portion for engaging with the first engaging portion. When the switching guide is situated at the first guiding position, the first engaging portion engages with the second engaging portion.

According to the aspect of the present invention, when the switching guide is situated at the first guiding position, the first engaging portion engages with the second engaging portion. Accordingly, it is possible to restrict the first engaging portion from being moved, so that the switching guide is restricted to be moved. As a result, even though the switching guide is curved or deformed, it is possible to stably guide the medium when the switching guide switches a guiding route.

DETAILED DESCRIPTION OF PREFERRED EMBODIMENTS

Hereunder, embodiments of the present invention will be explained with reference to the accompanying drawings. It should be noted that the embodiments are directed to a printer as an image forming apparatus.

First Embodiment

Figure 2:
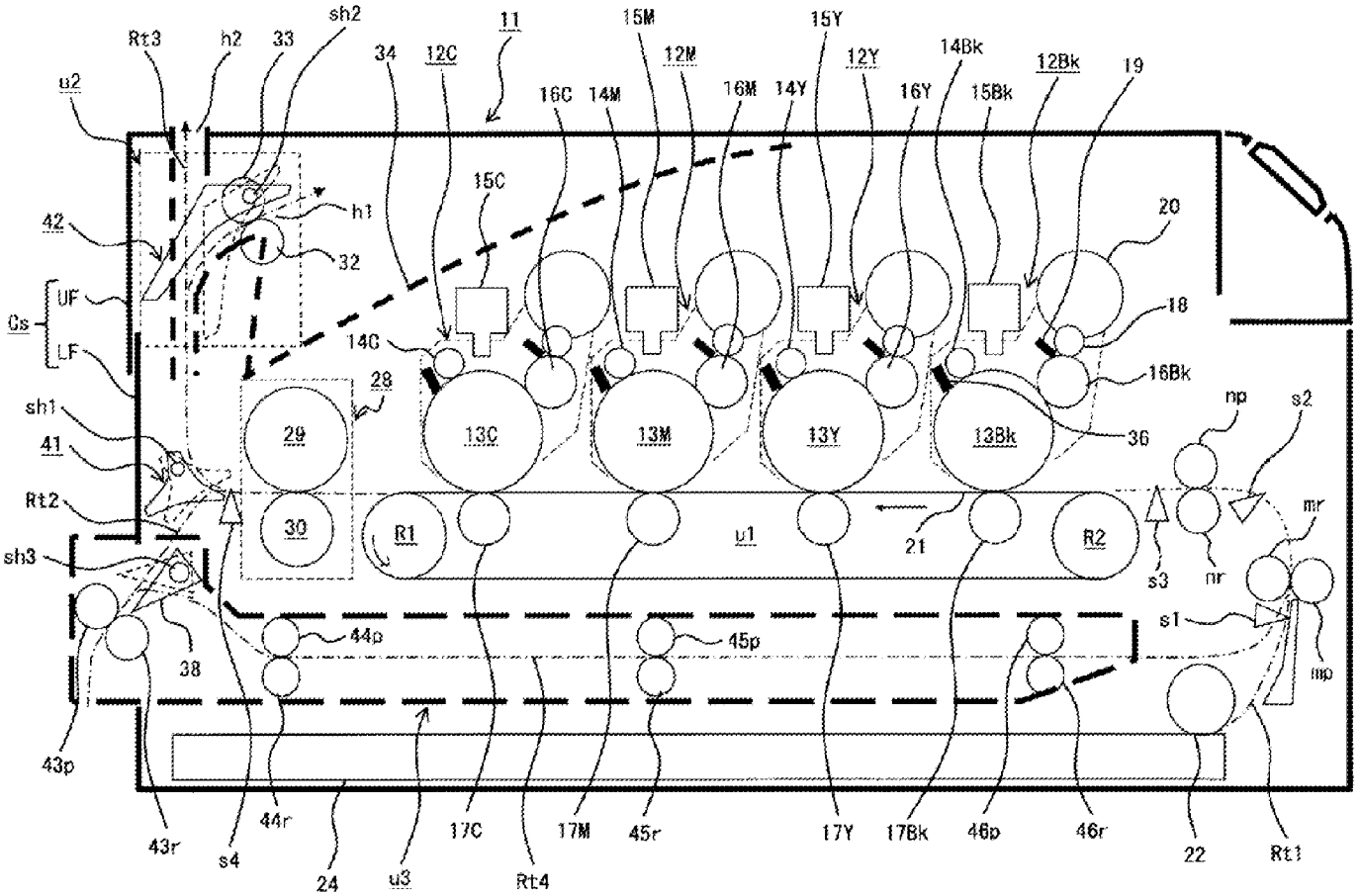
FIG. 2 is a schematic sectional view showing a configuration of the printer according to the first embodiment of the present invention.

A first embodiment of the present invention will be explained. FIG. 2 is a schematic sectional view showing a configuration of a printer 11 according to the first embodiment of the present invention.

As shown in FIG. 2, the printer 11 includes a casing Cs formed of an upper frame UF and a lower frame LF. In the casing Cs, there are disposed four image forming units 12Bk, 12Y, 12M, and 12C as an image forming portion arranged from an upstream side toward a downstream side in a transportation direction of a sheet (not shown) as a medium. The image forming units 12Bk, 12Y, 12M, and 12C are configured to form toner images as developer images in colors of black, yellow, magenta, and yellow, respectively. It should be noted that an OHP (Over Head Projector) sheet, an envelope, a copy sheet, a special sheet, and the like are used as the medium.

In the first embodiment, the image forming units 12Bk, 12Y, 12M, and 12C include photosensitive drums 13Bk, 13Y, 13M, and 13C as image supporting members; and charging rollers 14Bk, 14Y, 14M, and 14C as charging devices for uniformly charging surfaces of the photosensitive drums 13Bk, 13Y, 13M, and 13C. Further, the image forming units 12Bk, 12Y, 12M, and 12C include developing rollers 16Bk, 16Y, 16M, and 16C as developer image supporting members for attaching toner as developer to static latent images formed as latent images on the surfaces of the photosensitive drums 13Bk, 13Y, 13M, and 13C, so that toner images in colors of black, yellow, magenta, and yellow are formed.

In the first embodiment, each of the image forming units 12Bk, 12Y, 12M, and 12C further includes a toner supplying roller 18 as a developer supplying member arranged to abut against each of the developing rollers 16Bk, 16Y, 16M, and 16C. The toner supplying roller 18 is provided for supplying toner supplied from a toner cartridge 20 as a developer cartridge to each of the developing rollers 16Bk, 16Y, 16M, and 16C. Further, each of the image forming units 12Bk, 12Y, 12M, and 12C includes a developing blade 19 as a developer regulating member arranged to abut against each of the developing rollers 16Bk, 16Y, 16M, and 16C. The developing blade 19 is provided for forming a thin layer of toner supplied the toner supplying roller 18. Further, each of the image forming units 12Bk, 12Y, 12M, and 12C includes a cleaning blade 36 as a cleaning member arranged to abut against each of the photosensitive drums 13Bk, 13Y, 13M, and 13C. The cleaning blade 36 is provided for scraping off and removing toner attached and remaining on the surfaces of the photosensitive drums 13Bk, 13Y, 13M, and 13C after the toner images are transferred to the medium.

In the first embodiment, each of the image forming units 12Bk, 12Y, 12M, and 12C includes a developing unit as a developing device formed of each of the developing rollers 16Bk, 16Y, 16M, and 16C, each of the toner supplying rollers 18, each of the developing blades 19, each of the toner cartridges 20, and the like.

In the first embodiment, the image forming units 12Bk, 12Y, 12M, and 12C further include LED (Light Emitting Diode) heads 15Bk, 15Y, 15M, and 15C as an exposure device arranged above the photosensitive drums 13Bk, 13Y, 13M, and 13C to face the photosensitive drums 13Bk, 13Y, 13M, and 13C. The LED heads 15Bk, 15Y, 15M, and 15C are provided for exposing the photosensitive drums 13Bk, 13Y, 13M, and 13C to form the static latent images on the photosensitive drums 13Bk, 13Y, 13M, and 13C according to image data as image data of each color.

In the first embodiment, the printer 11 further include a transfer unit u1 arranged under the photosensitive drums 13Bk, 13Y, 13M, and 13C in the image forming units 12Bk, 12Y, 12M, and 12C. The transfer unit u1 includes a drive roller R1 arranged as a first roller to be freely rotatable in an arrow direction, and a follower roller R2 arranged as a second roller to be rotated when the drive roller R1 rotates. The transfer unit u1 further includes a transportation belt 12 having an endless shape extended between the drive roller R1 and the follower roller R2. The transportation belt 12 is provided as a transportation member for transporting a sheet, and is moved in an arrow direction when the drive roller R1 rotates.

Further, the transfer unit u1 includes transfer rollers 17Bk, 17Y, 17M, and 17C arranged to face the photosensitive drums 13Bk, 13Y, 13M, and 13C, respectively, with a transportation belt 21 in between. The transfer rollers 17Bk, 17Y, 17M, and 17C are arranged as transfer members to be freely rotatable, and are provided for transferring the toner image in each color formed on the photosensitive drums 13Bk, 13Y, 13M, and 13C to the sheet, so that a toner image in colors is formed on the sheet. It should be noted that the follower roller R2 is provided with a spring (not shown) is as an urging member for urging the follower roller R2 away from the drive roller R1, so that a specific tensional force is applied to the transportation belt 21.

In the first embodiment, the printer 11 further includes a sheet supplying mechanism arranged under the casing Cs for supplying the sheet to a medium transportation path Rt1 as a main transportation path. The sheet supplying mechanism includes a sheet cassette 24 as a medium storage portion for storing the sheet; a sheet supplying roller 22 for feeding the sheet separated with a separation device (not shown) one by one from the sheet cassette 24; and the like.

In the first embodiment, a first inlet sensor s1 as a first medium detecting portion is disposed on the downstream side from the sheet supplying roller 22 in the medium transportation path Rt1, and transportation rollers mr and mp as a pair of first transportation rollers are on the downstream side from the first inlet sensor s1 in the medium transportation path Rt1. Further, a second inlet sensor s2 as a second medium detecting portion is disposed on the downstream side from the transportation rollers mr and mp in the medium transportation path Rt1, and transportation rollers nr and np as a pair of second transportation rollers are on the downstream side from the second inlet sensor s2 in the medium transportation path Rt1. Further, a writing sensor s3 as a third medium detecting portion is disposed on the downstream side from the transportation rollers nr and np in the medium transportation path Rt1, and the image forming units 12Bk, 12Y, 12M, and 12C and the transfer unit u1 are disposed on the downstream side of the writing sensor s3.

In the first embodiment, the printer 11 further includes a fixing device 28 as a fixing unit disposed on the downstream side from the image forming units 12Bk, 12Y, 12M, and 12C and the transfer unit u1 in the medium transportation path Rt1. The fixing device 28 includes therein a heater 87 (refer to FIG. 4) such as a halogen lamp and the like (described later). Further, the fixing device 28 includes a heating roller 29 as a first fixing member for heating toner of the toner image in colors, and a pressing roller 30 as a second fixing member arranged to abut against the heating roller 29 for pressing the sheet. The fixing device 28 is provided for fixing the toner image in colors on the sheet to the sheet, so that the color image is formed.

In the first embodiment, a discharge sensor s4 as a fourth medium detecting portion is disposed on the downstream side from the fixing device 28 in the medium transportation path Rt1. Further, a medium transportation path Rt2 as a retracting transportation path is disposed on the downstream side from the discharge sensor s4 and branched from the medium transportation path Rt1 for retracting the sheet. Further, a first discharging guide 41 as a first switching member is disposed at a branch point of the medium transportation path Rt1 and the medium transportation path Rt2 for switching a guiding route, that is, a route for guiding the sheet, between the medium transportation path Rt1 and the medium transportation path Rt2. The first discharging guide 41 is arranged to be freely rotatable around a rotation shaft sh1 as a pivot portion thereof.

In the first embodiment, the printer 11 further includes a medium discharging unit u2 as a medium transportation device disposed on the downstream side from the first discharging guide 41 in the medium transportation path Rt1. The medium discharging unit u2 is provided for transporting the sheet with the color image formed thereon, and discharging the sheet outside the main body of the printer 11, that is, the apparatus main body.

In the first embodiment, the medium discharging unit u2 includes discharging rollers 32 and 33 as a pair of third transportation rollers or medium discharging rollers arranged to abut against with each other and to face a first discharging outlet h1 formed in the casing Cs for discharging the sheet outside the apparatus main body. Further, the medium discharging unit u2 includes a stacker 34 as a medium placing portion for placing the sheet discharged with the discharging rollers 32 and 33.

In the first embodiment, the medium discharging unit u2 further includes a medium transportation path Rt3 as a post processing transportation path disposed on the downstream side from the first discharging guide 41 in the medium transportation path Rt1. The medium transportation path Rt3 is branched from the medium transportation path Rt1 and communicated with a second discharging outlet h2 formed in the casing Cs. Further, the medium discharging unit u2 includes a second discharging guide 42 as a second switching member or a switching guide disposed at a branch point of the medium transportation path Rt1 and the medium transportation path Rt3 for switching the guiding route between the medium transportation path Rt1 and the medium transportation path Rt3. It should be noted that the discharging roller 32 constitutes a first roller of the medium discharging unit u2, and the discharging roller 33 constitutes a second roller of the medium discharging unit u2.

In the first embodiment, the second discharging guide 42 is arranged to freely rotate or swing around a rotation shaft sh2 as a pivot portion thereof disposed coaxially with the discharging roller 33. The discharging rollers 32 and 33 are disposed at a plurality of locations (two locations in the first embodiment) with a specific distance in between along a direction substantially perpendicular to a transportation direction of the sheet, that is, a longitudinal direction of the second discharging guide 42. It should be noted that the discharging rollers 32 and 33 are disposed along the direction substantially perpendicular to the transportation direction of the sheet by an angle within a range equal to or greater than 80° and equal to or smaller than 100°. It also should be noted that the discharging rollers 32 and 33 disposed at one of the two locations constitute a first roller pair of the medium discharging unit u2, and the discharging rollers 32 and 33 disposed at the other of the two locations constitute a second roller pair of the medium discharging unit u2.

In the first embodiment, the first discharging guide 41 is arranged to be freely switched between a medium transportation guiding position as a first guiding position for transporting the sheet through the medium transportation path Rt1 and a medium retraction guiding position as a second guiding position for transporting the sheet through the medium transportation path Rt2. When the first discharging guide 41 is switched to the medium transportation guiding position, the transportation route including the medium transportation path Rt1 is set as the guiding route of the sheet. When the first discharging guide 41 is switched to the medium retraction guiding position, the retraction route including the medium transportation path Rt2 is set as the guiding route of the sheet.

In the first embodiment, the second discharging guide 42 is arranged to be freely switched between a medium discharging guiding position as a first guiding position for discharging the sheet through the medium transportation path Rt1 and a medium post processing guiding position as a second guiding position for discharging the sheet through the medium transportation path Rt3. When the second discharging guide 42 is switched to the medium discharging guiding position, the discharging route including the medium transportation path Rt1 is set as the guiding route of the sheet. When the second discharging guide 42 is switched to the medium post processing guiding position, the post processing route including the medium transportation path Rt3 is set as the guiding route of the sheet.

In the first embodiment, it should be noted that a post processing device (not shown) such as a finisher for performing a post processing including sorting and stapling is disposed to face the second discharging outlet h2.

In the first embodiment, the printer 11 further includes a duplex unit u3 disposed on the downstream side from the first discharging guide 41. The duplex unit u3 is provided for reversing the sheet when a duplex printing operation is performed through forming images on one side surface (a front surface) and the other side surface (a backside surface) of the sheet. The duplex unit u3 includes transportation rollers 43*r* and 43*p* as a pair of fourth transportation rollers.

In the first embodiment, the duplex unit u3 further includes a medium transportation path Rt4 as a reverse transportation path branched from the medium transportation path Rt2 and connected to the medium transportation path Rt1 in front of the transportation rollers mr and mp. Further, the duplex unit u3 includes a switching guiding guide 38 as a third switching member or disposed at a branch point of the medium transportation path Rt2 and the medium transportation path Rt4 for switching the guiding route between the medium transportation path Rt2 and the medium transportation path Rt4. The duplex unit u3 includes in the medium transportation path Rt4 transportation rollers 44*r* and 44*p* as a pair of fifth transportation rollers; transportation rollers 45*r* and 45*p* as a pair of sixth transportation rollers; and transportation rollers 46*r* and 46*p* as a pair of seventh transportation rollers. It should be noted that the switching guiding guide 38 is arranged to be freely rotatable around a rotation shaft sh3 as a pivot portion thereof.

Figure 3:
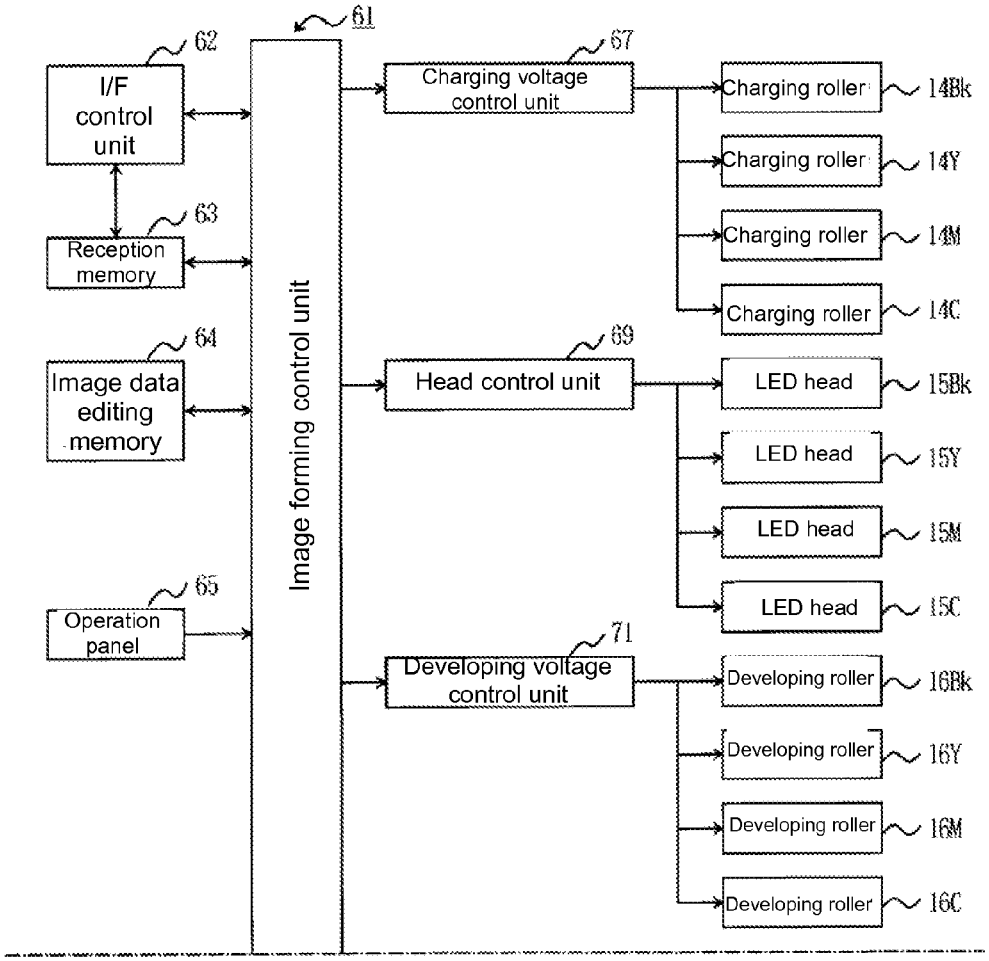
FIG. 3 is a block diagram No. 1 showing a configuration of a control system of the printer according to the first embodiment of the present invention.
Figure 4:
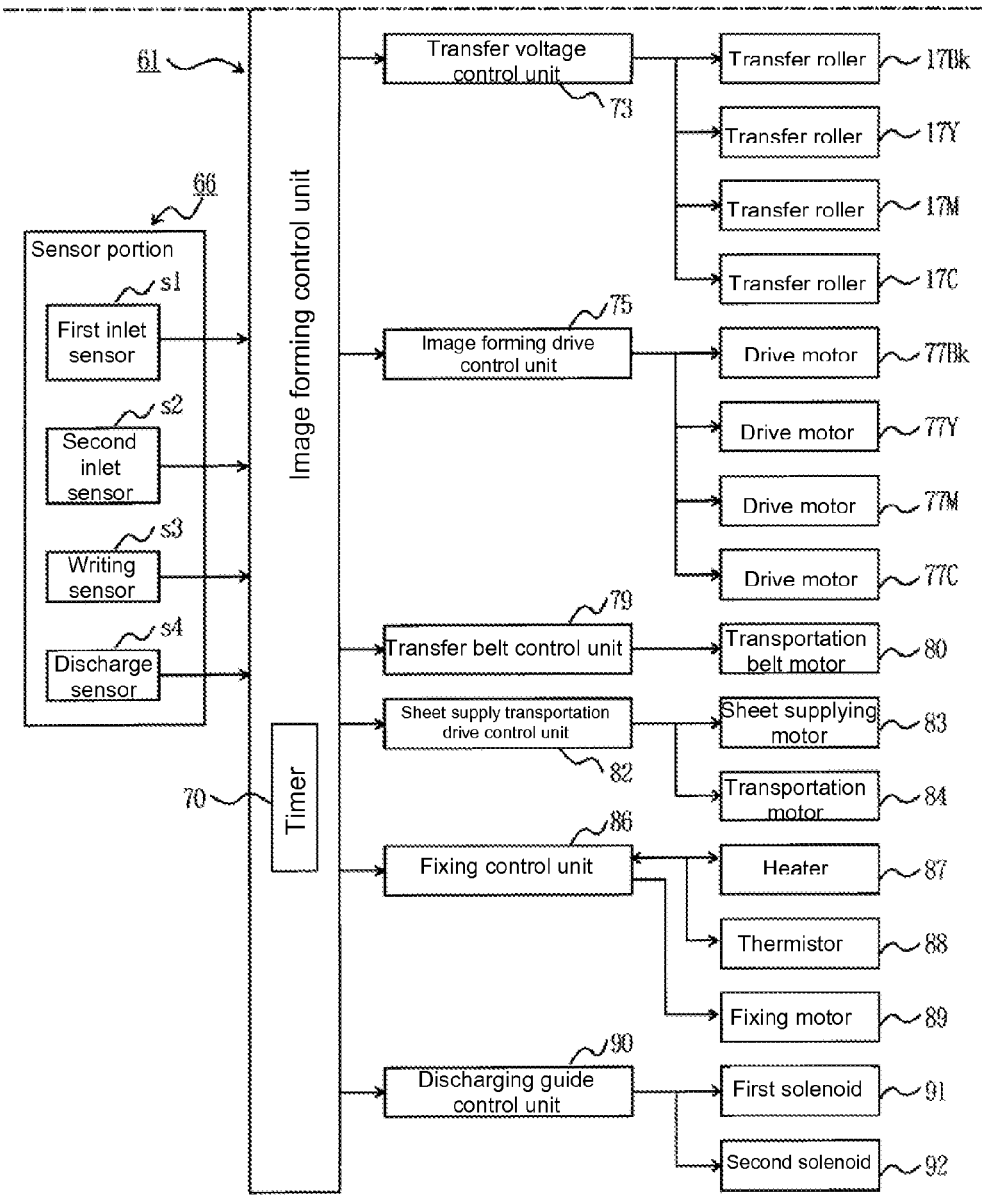
FIG. 4 is a block diagram No. 2 showing the configuration of the control system of the printer according to the first embodiment of the present invention.

A control system of the printer 11 having the configuration described above will be explained next. FIG. 3 is a block diagram No. 1 showing a configuration of the control system of the printer 11 according to the first embodiment of the present invention. FIG. 4 is a block diagram No. 2 showing the configuration of the control system of the printer 11 according to the first embodiment of the present invention.

As shown in FIGS. 3 and 4, the control system of the printer 11 includes an image forming control unit 61 and an I/F (interface) control unit 62. The image forming control unit 61 includes a microprocessor (not shown), an ROM (Read Only Memory, not shown), an RAM (Random Access Memory, not shown), an input-output port (not shown), a timer 70, and the like. Further, the image forming control unit 61 is configured to receive print data and a control command from a host computer (not shown) as an upper device through the I/F (interface) control unit 62, and to control sequentially the entire portion of the printer 11, thereby performing the printing operation. The I/F (interface) control unit 62 is configured to transmit printer information representing a state of the printer 11 to the host computer; analyze the control command received from the host computer; process the print data received from the host computer; and temporarily store the print data in a reception memory 63 per each color.

In the first embodiment, the image forming control unit 61 is further configured to retrieve the print data from the reception memory 63 as image data; perform an editing operation on the image data; and store the image data in an image data editing memory 64.

In the first embodiment, the control system of the printer 11 further includes an operation panel 65 as an operation portion. The operation panel 65 includes an LED (Light Emitting Diode) panel (not shown) as a display element for displaying the state of the printer 11; and a switch (not shown) as an operation element for an operator to input an instruction to the printer 11.

In the first embodiment, the control system of the printer 11 further includes a sensor portion 66 including a plurality of sensors such as the first inlet sensor s1, the second inlet sensor s2, the writing sensor s3, and the discharge sensor s4 for detecting the transportation position of the sheet. A sensor output from each of the sensors of the sensor portion 66 is transmitted to the image forming control unit 61.

In the first embodiment, the control system of the printer 11 further includes, each thereof connected to the image forming control unit 61, a charging voltage control unit 67; a head control unit 69; a developing voltage control unit 71; a transfer voltage control unit 73; an image forming drive control unit 75 as a first drive control unit; a transfer belt control unit 79 as a second drive control unit; a sheet supply transportation drive control unit 82 as a third drive control unit; a fixing control unit 86; and a discharging guide control unit 90 as a discharging drive control unit.

In the first embodiment, when the charging voltage control unit 67 receives an instruction from the image forming control unit 61, the charging voltage control unit 67 is configured to apply a charging voltage to each of the charging rollers 14Bk, 14Y, 14M, and 14C, so that the charging rollers 14Bk, 14Y, 14M, and 14C uniformly charge the surfaces of the photosensitive drums 13Bk, 13Y, 13M, and 13C (refer to FIG. 2).

In the first embodiment, when the head control unit 69 receives an instruction from the image forming control unit 61 and the image data in each color stored in the image data editing memory 64, the head control unit 69 is configured to transmit the image data in each color to each of the LED heads 15Bk, 15Y, 15M, and 15C, so that LED elements of an LED array (not shown) disposed in the LED heads 15Bk, 15Y, 15M, and 15C selectively emit light to irradiate the surfaces of the photosensitive drums 13Bk, 13Y, 13M, and 13C. As a result, the static latent images are formed on the photosensitive drums 13Bk, 13Y, 13M, and 13C.

In the first embodiment, when the developing voltage control unit 71 receives an instruction from the image forming control unit 61, the developing voltage control unit 71 is configured to apply the developing voltage each of the developing rollers 16Bk, 16Y, 16M, and 16C, so that toner is attached to the static latent images formed on the surfaces of the photosensitive drums 13Bk, 13Y, 13M, and 13C. As a result, the toner images are formed on the photosensitive drums 13Bk, 13Y, 13M, and 13C.

In the first embodiment, when the transfer voltage control unit 73 receives an instruction from the image forming control unit 61, the transfer voltage control unit 73 is configured to apply the transfer voltage each of the transfer rollers 17Bk, 17Y, 17M, and 17C, so that the toner images formed on the photosensitive drums 13Bk, 13Y, 13M, and 13C are transferred to the sheet.

In the first embodiment, when the image forming drive control unit 75 receives an instruction from the image forming control unit 61, the image forming drive control unit 75 is configured to drive the drive motors 77Bk, 77Y, 77M, and 77C as drive portions for forming the image. Accordingly, the photosensitive drums 13Bk, 13Y, 13M, and 13C; the charging rollers 14Bk, 14Y, 14M, and 14C; and the developing rollers 16Bk, 16Y, 16M, and 16C are rotated to form the image.

In the first embodiment, when the transfer belt control unit 79 receives an instruction from the image forming control unit 61, the transfer belt control unit 79 is configured to drive a transportation belt motor 80 as a drive portion for moving the transportation belt 21 (refer to FIG. 2). Accordingly, the drive roller R1 is rotated to move the transportation belt 21.

In the first embodiment, when the sheet supply transportation drive control unit 82 receives an instruction from the image forming control unit 61, the sheet supply transportation drive control unit 82 is configured to drive a sheet supplying motor 83 as a drive portion for supplying the sheet. Accordingly, the sheet supplying roller 22 rotates to feed the sheet from the sheet cassette 24. Further, the sheet supply transportation drive control unit 82 is configured to drive a transportation motor 84 as a drive portion for transporting the sheet. Accordingly, the transportation rollers mr, mp, nr, np, 43*r*, 43*p*, 44*r*, 44*p*, 45*r*, 45*p*, 46*r*, and 46*p* are rotated to transport the sheet.

In the first embodiment, when the fixing control unit 86 receives an instruction from the image forming control unit 61, the fixing control unit 86 is configured to supply a fixing electric current to the heater 87 disposed inside the heating roller 29, so that toner of the toner image in colors is heated. It should be noted that, in the fixing control unit 86, the heater 87 is controlled to turn on or off according to a detected temperature detected with a thermistor 88 as a fixing temperature detecting portion. When the fixing device 28 reaches a specific temperature, a fixing motor 89 is driven as a drive portion for fixing the toner images. Accordingly, the heating roller 29, the pressing roller 30, the discharging roller 32, and the discharging roller 33 are rotated.

In the first embodiment, when the discharging guide control unit 90 receives an instruction from the image forming control unit 61, the discharging guide control unit 90 is configured to drive (turn on) a first solenoid 91 as a first drive portion for switching. Accordingly, the first discharging guide 41 is rotated to switch the guiding route to the transportation route formed of the medium transportation path Rt1 or the retraction route formed of the medium transportation path Rt2. Further, the discharging guide control unit 90 is configured to drive (turn on) a second solenoid 92 as a second drive portion for switching. Accordingly, the second discharging guide 42 is rotated to switch the guiding route to the discharging route formed of the medium transportation path Rt1 or the post processing route formed of the medium transportation path Rt3.

In the first embodiment, the first solenoid 91 includes a first lever (not shown) as a first operation member. When the first solenoid 91 is driven, the first lever is moved forward, so that the first discharging guide 41 is situated at the medium retraction guiding position. When the first solenoid 91 is not driven (turned off), the first lever is moved backward, so that the first discharging guide 41 is situated at the medium transportation guiding position.

In the first embodiment, the second solenoid 92 includes a second lever (not shown) as a second operation member. When the second solenoid 92 is driven, the second lever is moved forward, so that the second discharging guide 42 is situated at the medium post processing guiding position. When the second solenoid 92 is not driven (turned off), the second lever is moved backward, so that the second discharging guide 42 is situated at the medium discharging guiding position.

An operation of the printer 11 will be explained next. In the operation, the printer 11 forms the image on one side surface of the sheet, and the discharging roller 32 and the discharging roller 33 discharge the sheet outside the apparatus main body.

In the first embodiment, the image forming control unit 61 receives the control command and the print data transmitted from the host computer through the I/F (interface) control unit 62. When the image forming control unit 61 receives the instruction of forming the image on one side surface of the sheet according to the control command, the image forming control unit 61 instructs the discharging guide control unit 90 to drive the first solenoid 91 and the second solenoid 92, so that the first discharging guide 41 is situated at the medium retraction guiding position and the second discharging guide 42 is situated at the medium post processing guiding position.

In the next step, the image forming control unit 61 instructs the sheet supply transportation drive control unit 82 to drive the sheet supplying motor 83 to rotate the sheet supplying roller 22, so that the sheet is fed from the sheet cassette 24. In the next step, the image forming control unit 61 retrieves the sensor output of the first inlet sensor s1 to determine whether the sheet supplying roller 22 feeds the sheet properly. When the image forming control unit 61 determines that the sheet supplying roller 22 does not feed the sheet properly, the image forming control unit 61 instructs the sheet supply transportation drive control unit 82 once again to drive the sheet supplying motor 83 to rotate the sheet supplying roller 22, so that the sheet is fed from the sheet cassette 24.

When the image forming control unit 61 determines that the sheet supplying roller 22 feeds the sheet properly, the image forming control unit 61 retrieves the sensor output of the second inlet sensor s2 to control the driving timing of the transportation rollers nr and np, so that a leading edge of the sheet abuts against the transportation rollers nr and np. Accordingly, it is possible to correct skew of the sheet. Afterward, the transportation rollers nr and np transport the sheet between the transfer unit u1 and the image forming units 12Bk, 12Y, 12M, and 12C.

It should be noted that, in the image forming units 12Bk, 12Y, 12M, and 12C, when the sheet supplying motor 83 starts being driven, the drive motors 77Bk, 77Y, 77M, and 77C start being driven. Accordingly, the photosensitive drums 13Bk, 13Y, 13M, and 13C, the charging rollers 14Bk, 14Y, 14M, and 14C, the developing rollers 16Bk, 16Y, 16M, and 16C, the toner supplying roller 18, and the like start rotating. At this moment, the image forming control unit 61 instructs the charging voltage control unit 67 to apply a voltage with negative polarity (about −1,000 V) to the charging rollers 14Bk, 14Y, 14M, and 14C, so that the surfaces of the photosensitive drums 13Bk, 13Y, 13M, and 13C are charged.

In the next step, toner in each color is supplied from the toner cartridge 20 to each of the developing rollers 16Bk, 16Y, 16M, and 16C through the toner supplying roller 18. After toner in each color is supplied to each of the developing rollers 16Bk, 16Y, 16M, and 16C, the developing blade 19 applies friction to and charges toner. Further, the developing blade 19 forms a thin layer of toner to be the toner layer.

Further, at the same time when the drive motors 77Bk, 77Y, 77M, and 77C start being driven, the transportation belt motor 80 starts being driven to rotate the drive roller R1. Accordingly, the transportation belt 21 is moved at a circumferential speed the same as that of the photosensitive drums 13Bk, 13Y, 13M, and 13C while the photosensitive drums 13Bk, 13Y, 13M, and 13C are rotating.

In the next step, the transportation rollers nr and np rotate to transport the sheet further. When the writing sensor s3 detects the leading edge of the sheet, the image forming control unit 61 retrieves the sensor output of the writing sensor s3. When a specific period of time is elapsed after the image forming control unit 61 retrieves the sensor output of the writing sensor s3, the image forming control unit 61 instructs the head control unit 69 to drive the LED head 15Bk first to expose the surface of the photosensitive drum 13Bk, so that the static latent image is formed on the photosensitive drum 13Bk.

In the next step, the developing roller 16Bk attaches toner to the static latent image, so that the toner image is formed on the photosensitive drum 13Bk.

In the next step, when the sheet reaches between the photosensitive drum 13Bk and the transfer roller 17Bk, the image forming control unit 61 instructs the transfer voltage control unit 73 to apply a voltage with positive polarity to the transfer roller 17Bk, so that the transfer roller 17Bk transfers the toner image in black to the sheet.

Similarly, every time when a specific period of time is elapsed after the image forming control unit 61 retrieves the sensor output of the writing sensor s3, the image forming control unit 61 instructs the head control unit 69 to sequentially drive the LED heads 15Y, 15M, and 15C to expose the surfaces of the photosensitive drums 13Y, 13M, and 13C, so that the static latent images are formed on the photosensitive drums 13Y, 13M, and 13C.

In the next step, the developing rollers 16Y, 16M, and 16C attach toner to the static latent images, so that the toner images are formed on the photosensitive drums 13Y, 13M, and 13C.

In the next step, when the sheet reaches between the photosensitive drums 13Y, 13M, and 13C and the transfer rollers 17Y, 17M, and 17C, the image forming control unit 61 instructs the transfer voltage control unit 73 to apply a voltage with positive polarity to the transfer rollers 17Y, 17M, and 17C, so that the rollers 17Y, 17M, and 17C transfer the toner images in each color to the sheet.

Through the process described above, the toner images in each color are sequentially transferred to and overlapped on the sheet, thereby forming the color toner image. After the color image is formed on the sheet, the sheet is transported to the fixing device 28. Then, in the fixing device 28, the heating roller 29 heats the color toner image, and the pressing roller 30 presses the color toner image, thereby fixing the color toner image to the sheet.

After the color toner image is fixed to the sheet, the discharge sensor s4 detects the leading edge of the sheet. When the sensor output of the discharge sensor s4 is transmitted to the image forming control unit 61, the image forming control unit 61 instructs the discharging guide control unit 90 to stop driving the first solenoid 91, so that the first discharging guide 41 is situated at the medium transportation guiding position. Further, the image forming control unit 61 instructs the discharging guide control unit 90 to stop driving the second solenoid 92, so that the second discharging guide 42 is situated at the medium discharging guiding position. It should be noted that the discharge sensor s4 is provided for detecting a jam of the sheet in the fixing device 28, or a length of the sheet.

After the color image is formed on the sheet, the sheet is transported along the medium transportation path Rt1. Afterward, the discharging roller 32 and the discharging roller 33 discharge the sheet outside the apparatus main body, so that the sheet is placed on the stacker 34.

Figure 5:
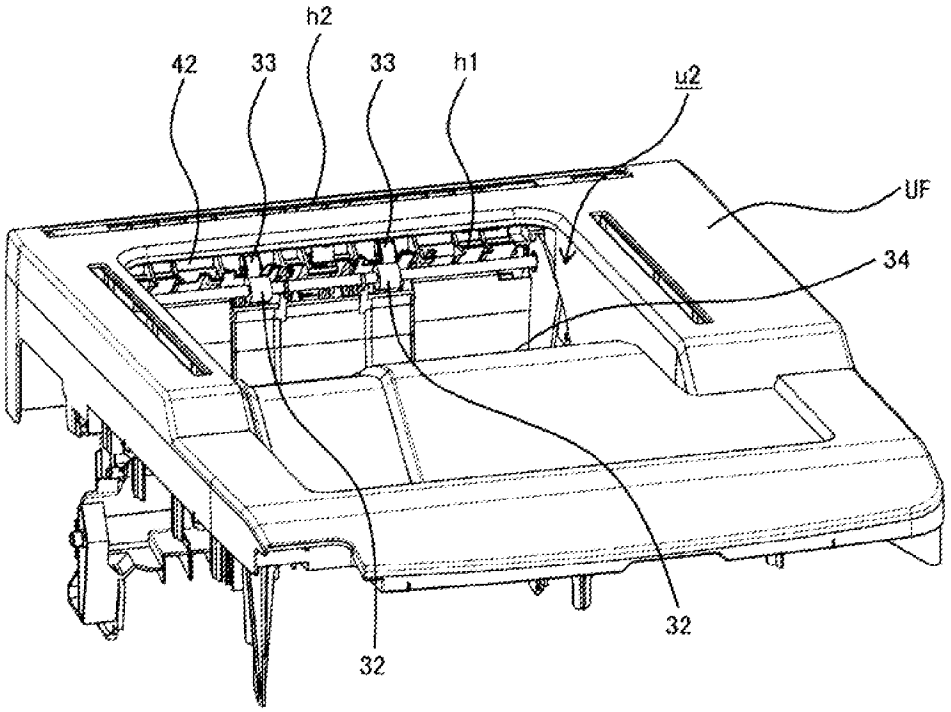
FIG. 5 is a perspective view showing the medium discharging unit of the printer according to the first embodiment of the present invention.
Figure 6:
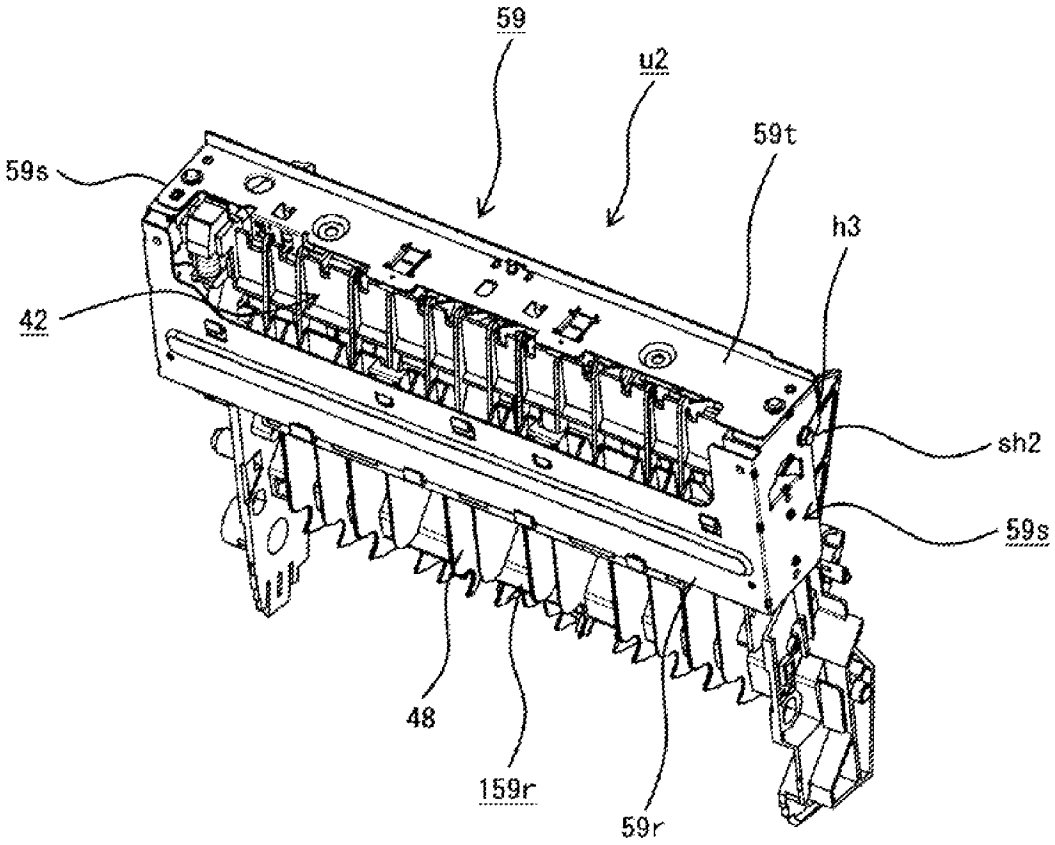
FIG. 6 is a perspective view showing the medium discharging unit of the printer viewed from a post processing route side according to the first embodiment of the present invention.
Figure 7:
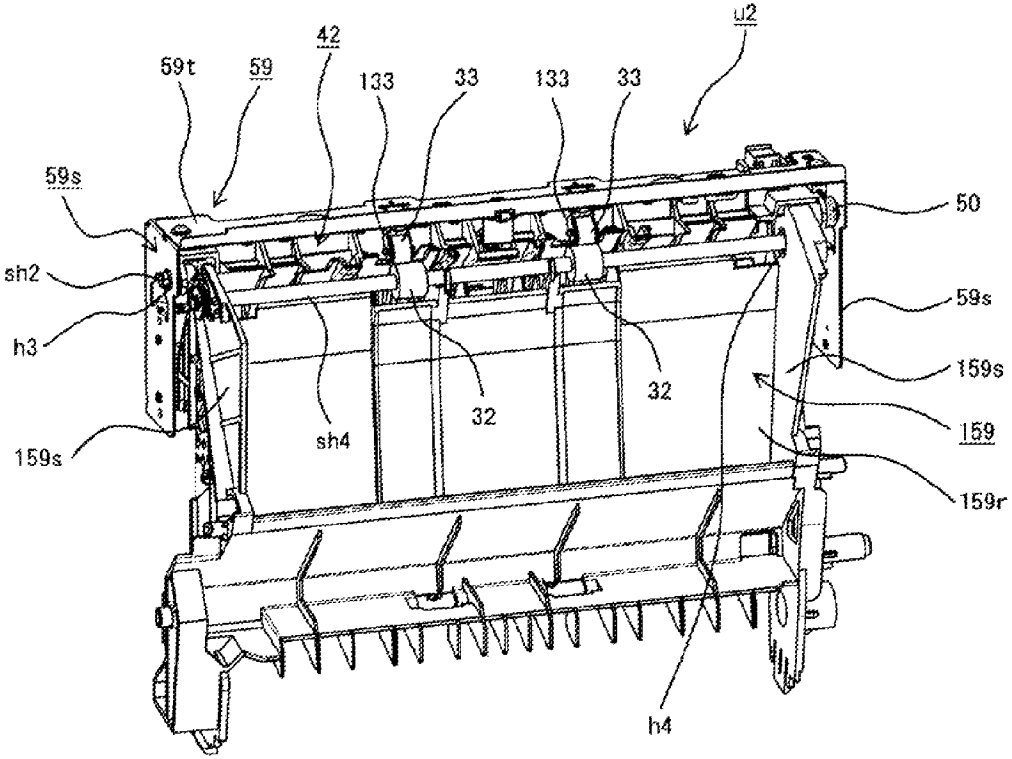
FIG. 7 is a perspective view showing the medium discharging unit of the printer viewed from a discharging route side according to the first embodiment of the present invention.

A configuration of the medium discharging unit u2 will be explained in more detail next. FIG. 5 is a perspective view showing the medium discharging unit u2 of the printer 10 according to the first embodiment of the present invention. FIG. 6 is a perspective view showing the medium discharging unit u2 of the printer 10 viewed from a post processing route side according to the first embodiment of the present invention. FIG. 7 is a perspective view showing the medium discharging unit u2 of the printer 10 viewed from a discharging route side according to the first embodiment of the present invention.

Figure 8:
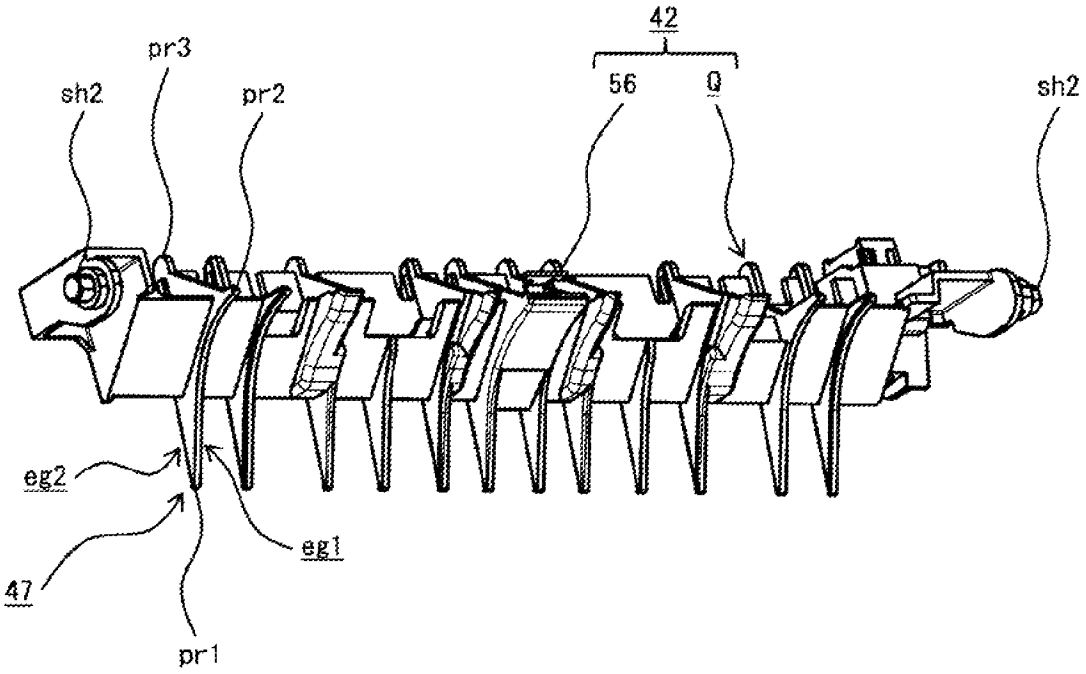
FIG. 8 is a perspective view showing a second discharging guide of the medium discharging unit of the printer viewed from the discharging route side according to the first embodiment of the present invention.
Figure 9:
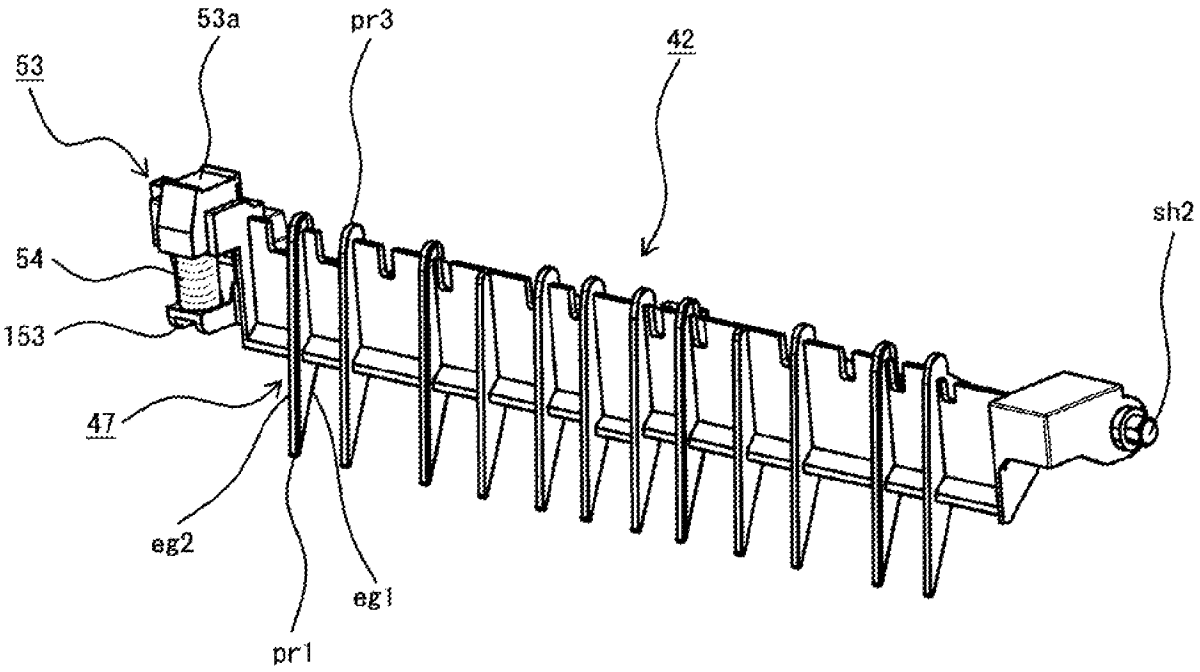
FIG. 9 is a perspective view showing the second discharging guide of the medium discharging unit of the printer viewed from the post processing route side according to the first embodiment of the present invention.
Figure 10:
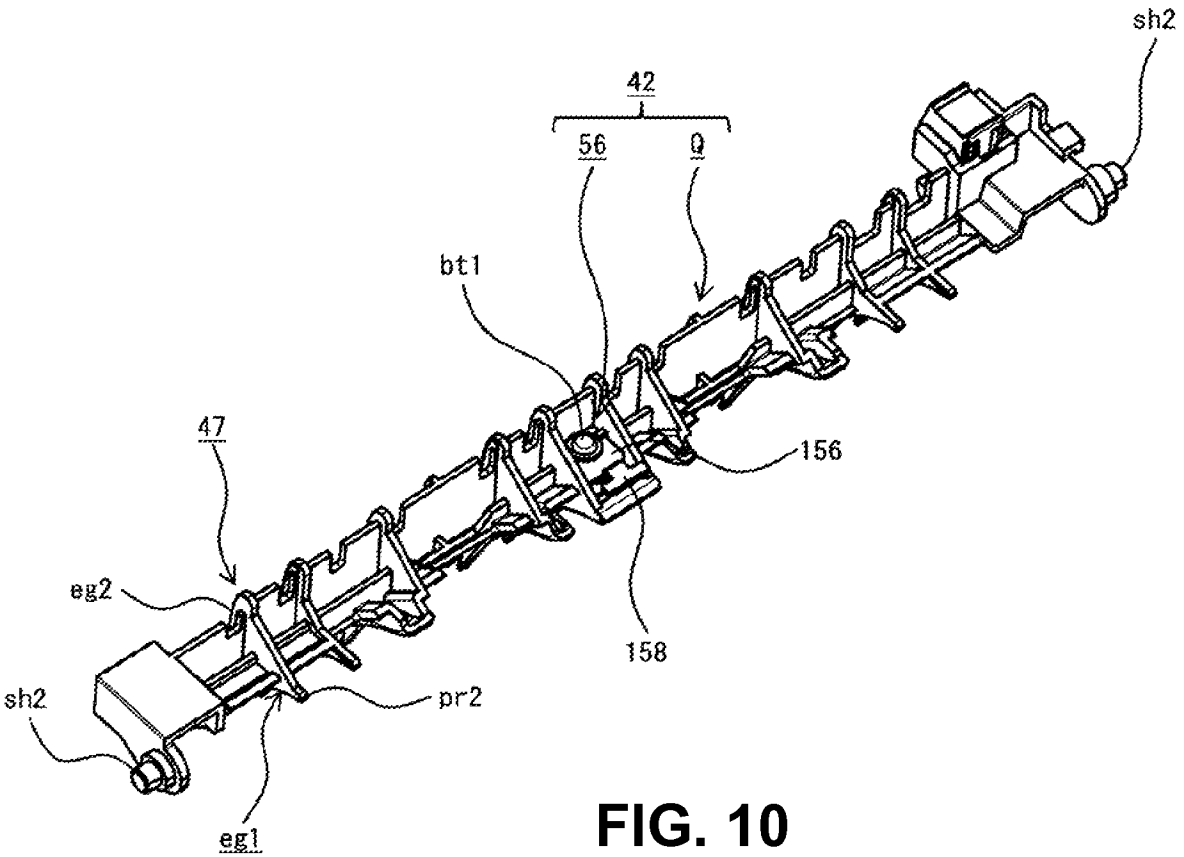
FIG. 10 is a perspective view showing the second discharging guide of the medium discharging unit of the printer viewed from an upper frame side according to the first embodiment of the present invention.

FIG. 8 is a perspective view showing the second discharging guide 42 of the medium discharging unit u2 of the printer 10 viewed from the discharging route side according to the first embodiment of the present invention. FIG. 9 is a perspective view showing the second discharging guide 42 of the medium discharging unit u2 of the printer 10 viewed from the post processing route side according to the first embodiment of the present invention. FIG. 10 is a perspective view showing the second discharging guide 42 of the medium discharging unit u2 of the printer 10 viewed from an upper frame side according to the first embodiment of the present invention.

Figure 11:
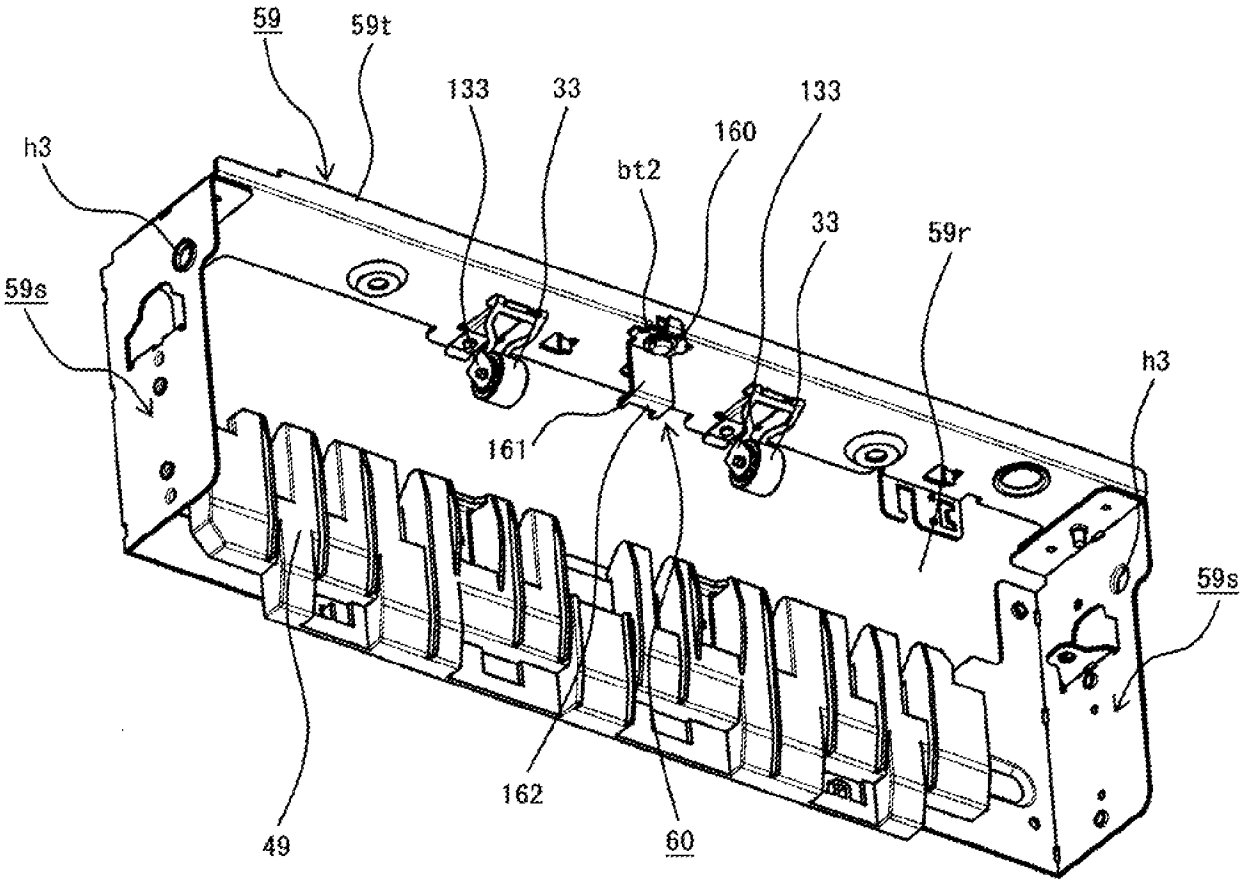
FIG. 11 is a perspective view No. 1 showing a stopper disposed on a first frame member of the medium discharging unit of the printer according to the first embodiment of the present invention.
Figure 12:
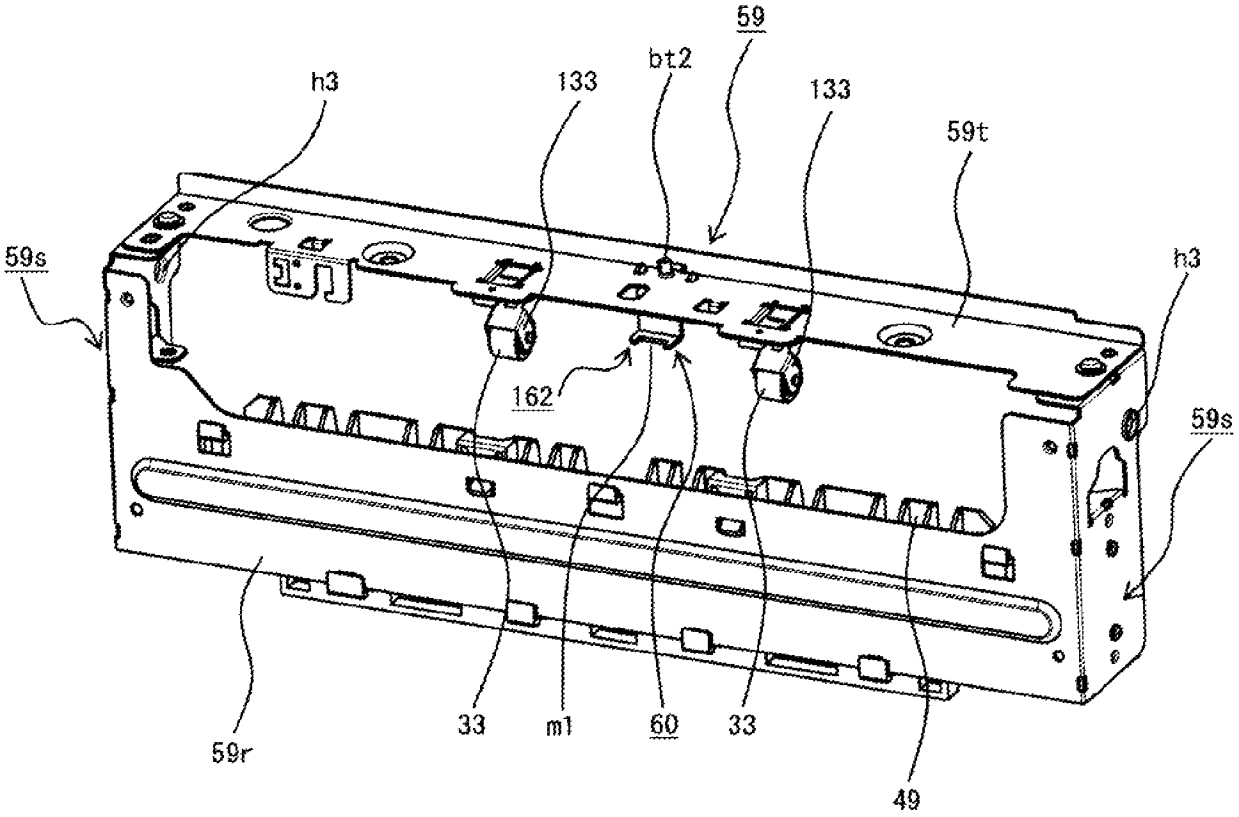
FIG. 12 is a perspective view No. 2 showing the stopper disposed on the first frame member of the medium discharging unit of the printer according to the first embodiment of the present invention.
Figure 13:
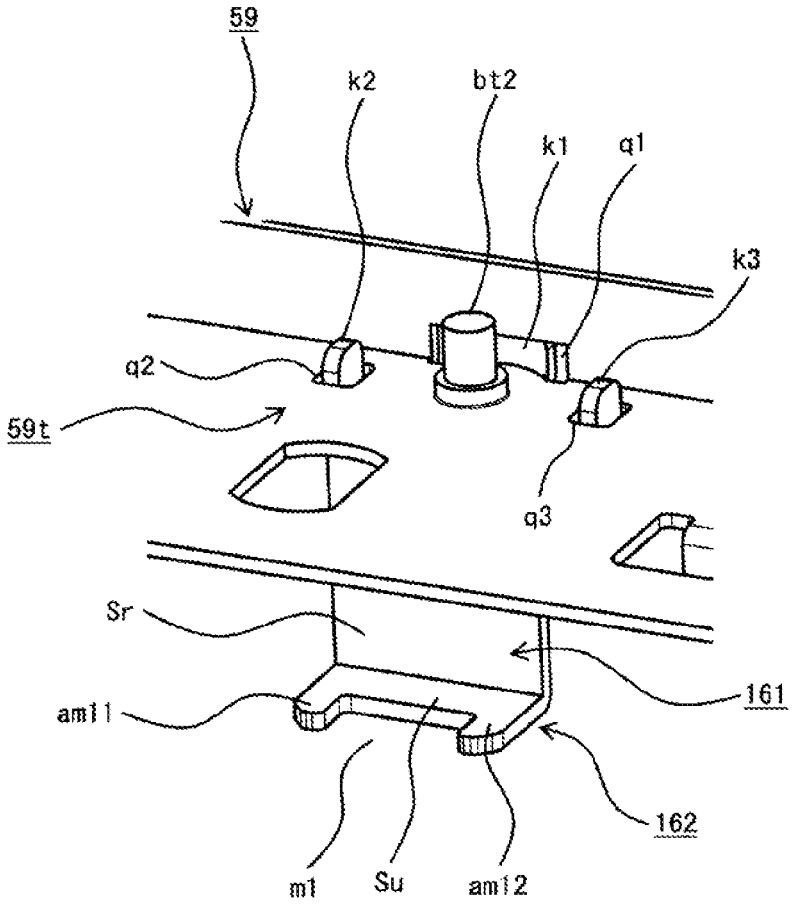
FIG. 13 is a perspective view showing a main portion of the first frame member of the medium discharging unit of the printer according to the first embodiment of the present invention.
Figure 14:
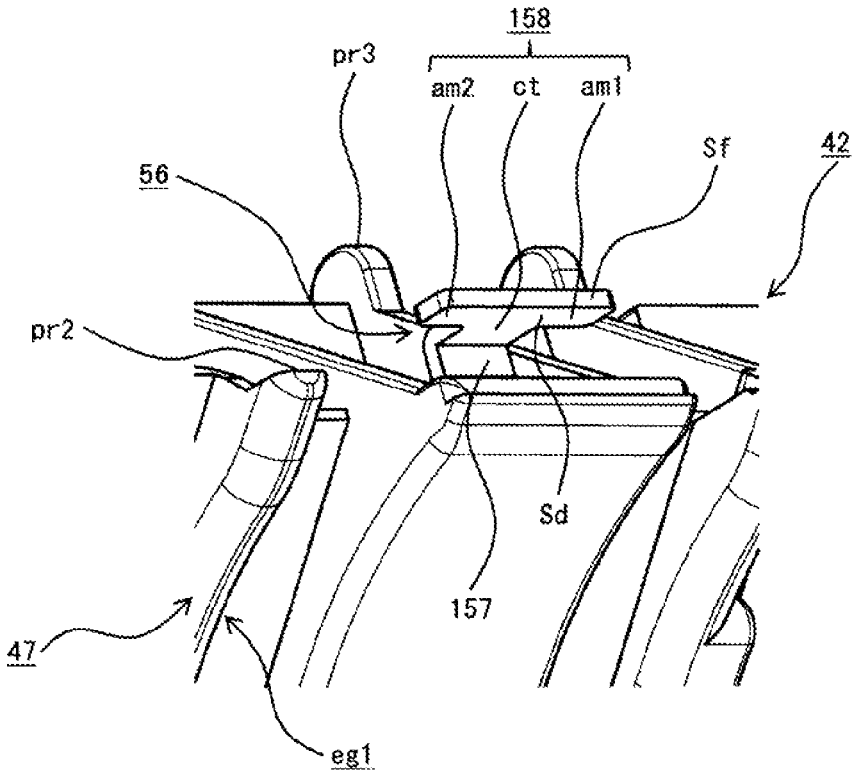
FIG. 14 is a perspective view showing a main portion of the second discharging guide of the medium discharging unit of the printer according to the first embodiment of the present invention.
Figure 15:
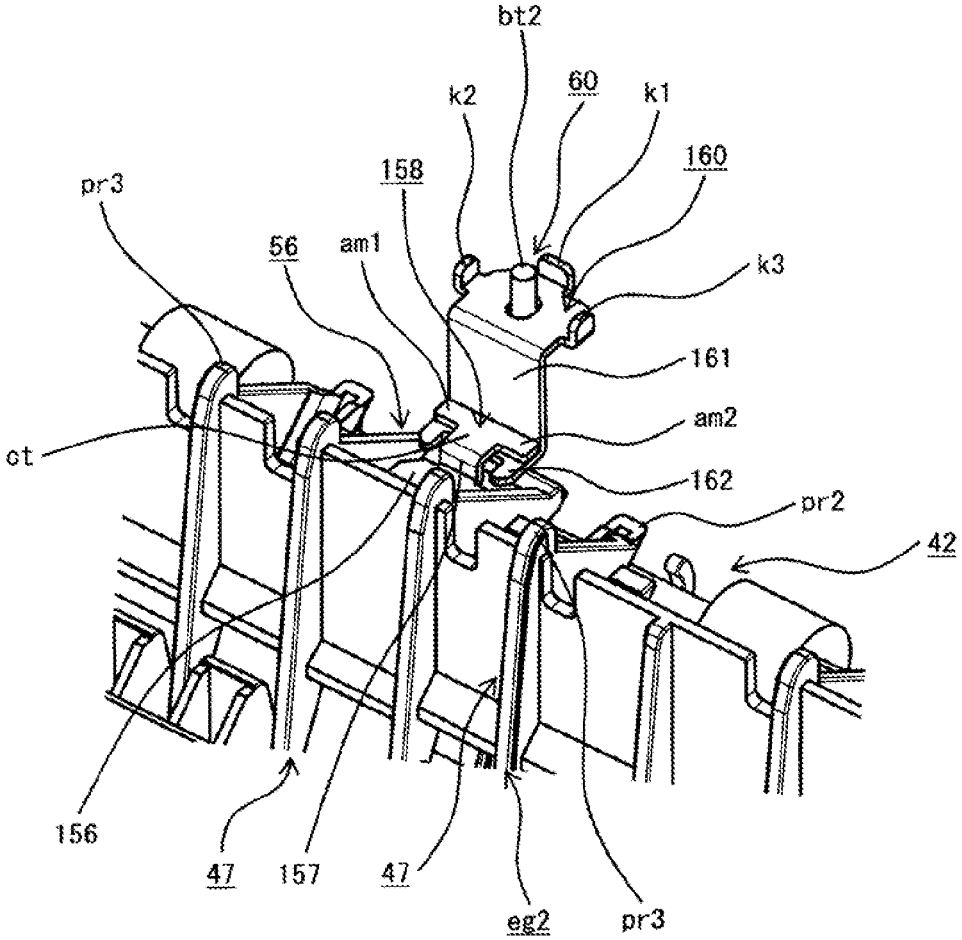
FIG. 15 is a perspective view showing the stopper and a hooking member of the medium discharging unit of the printer in an engaging state according to the first embodiment of the present invention.

FIG. 11 is a perspective view No. 1 showing a stopper 60 disposed on a first frame member 59 of the medium discharging unit u2 of the printer 10 according to the first embodiment of the present invention. FIG. 12 is a perspective view No. 2 showing the stopper 60 disposed on the first frame member 59 of the medium discharging unit u2 of the printer 10 according to the first embodiment of the present invention. FIG. 13 is a perspective view showing a main portion of the first frame member 59 of the medium discharging unit u2 of the printer 10 according to the first embodiment of the present invention. FIG. 14 is a perspective view showing a main portion of the second discharging guide 42 of the medium discharging unit u2 of the printer 10 according to the first embodiment of the present invention. FIG. 15 is a perspective view showing the stopper 60 and a hooking member 56 of the medium discharging unit u2 of the printer 10 in an engaging state according to the first embodiment of the present invention.

As shown in FIG. 5, the printer 11 includes the upper frame UF, and the medium discharging unit u2 is disposed under the upper frame UF. Further, the printer 11 includes the stacker 34; the first discharging outlet h1; the second discharging outlet h2; the discharging roller 32; the discharging roller 33; and the second discharging guide 42.

As shown in FIGS. 6 and 7, the medium discharging unit u2 includes the first frame member 59 formed of a sheet metal as a fixing member such that the first frame member 59 constitutes an outer casing of the medium discharging unit u2. Further, the medium discharging unit u2 includes a second frame member 159 disposed on a side of the stacker 34 from the first frame member 59 away from the first frame member 59 by a specific distance, such that the second frame member 159 constitutes an inner casing of the medium discharging unit u2. The first frame member 59 is provided for supporting the discharging roller 33 and the second discharging guide 42 to be freely rotatable, and the second frame member 159 is provided for supporting the discharging roller 32 to be freely rotatable.

In the first embodiment, the first frame member 59 includes a top wall portion 59*t* extending in parallel to the upper frame UF; left and right sidewall portions 59*s*; and a rear wall portion 59*r*. Further, the second frame member 159 includes left and right sidewall portions 159*s* extending in parallel to the left and right sidewall portions 59*s*, and a rear wall portion 159*r*.

In the first embodiment, the medium discharging unit u2 further includes a rotation supporting member 133 having a U-character shape section. The rotation supporting member 133 is disposed at a specific position on the top wall portion 59*t* of the first frame member 59, that is, a position where the discharging roller 33 is disposed. Further, the rotation supporting member 133 is formed to protrude downwardly, so that the rotation supporting member 133 supports the discharging roller 33 to be freely rotatable.

In the first embodiment, the rotation shaft sh2 is formed to protrude from both end portions of the second discharging guide 42 as a first supported element. A supporting hole h3 is formed as a first supporting element in each of the left and right sidewall portions 59*s* of the first frame member 59 at a position where the rotation shaft sh2 is disposed, so that the rotation shaft sh2 passes through the supporting hole h3 to be freely rotatable. Further, a roller shaft sh4 is disposed as a second supported element to pass through the discharging roller 32. A supporting hole h4 is formed as a second supporting element in each of the left and right sidewall portions 159*s* of the second frame member 159 at a position where the roller shaft sh4 is disposed, so that the roller shaft sh4 passes through the supporting hole h4 to be freely rotatable.

In the first embodiment, the second discharging guide 42 includes a plurality of switching ribs 47 for guiding the sheet transported from the first discharging guide 41 (refer to FIG. 2) to the medium transportation path Rt1 or the medium transportation path Rt3 according to the position of the second discharging guide 42. The switching ribs 47 are arranged along a longitudinal direction of the second discharging guide 42. Each of the switching ribs 47 is formed of a plate member having a substantially triangular shape. Further, each of the switching ribs 47 includes a pointy end portion pr1 formed on a side of the first discharging guide 41 in the medium transportation path Rt1; a discharging rib portion eg1 formed as a first edge portion to extend from the pointy end portion pr1 toward the first discharging outlet h1 on a side of the medium transportation path Rt1; and a post processing rib portion eg2 formed as a second edge portion to extend from the pointy end portion pr1 toward the second discharging outlet h2 on a side of the medium transportation path Rt3. It should be noted that the discharging rib portion eg1 and the post processing rib portion eg2 are arranged to form an acute angle at the pointy end portion pr1.

In the first embodiment, the discharging roller 32 is arranged to abut against the discharging roller 33 at a nip portion Np (refer to FIG. 21) as an abutting portion at the first discharging outlet h1. Each of the switching ribs 47 is configured such that the pointy end portion pr1 and an opposite end portion pr2 on the discharging rib portion eg1 protrude from the nip portion Np by a specific amount on the downstream side. Further, each of the switching ribs 47 is configured such that the pointy end portion pr1 and an opposite end portion pr3 on the post processing rib portion eg2 are situated close to the upper frame UF in the medium transportation path Rt1.

In the first embodiment, a plurality of discharging route ribs 48 is formed as a first opposing edge portion on the rear wall portion 159*r* of the second frame member 159. The discharging route ribs 48 protrude toward the discharging rib portions eg1, and are arranged along a width direction of the second frame member 159 (the longitudinal direction of the second discharging guide 42). Further, a plurality of post processing route ribs 49 is formed as a second opposing edge portion on the rear wall portion 59*r* of the first frame member 59. The post processing route ribs 49 are formed to face the post processing rib portion eg2 and protrude toward the post processing rib portion eg2. Further, the post processing route ribs 49 are arranged along a width direction of the first frame member 59 (the longitudinal direction of the second discharging guide 42).

With the configuration described above, in the first embodiment, when the guiding route is switched to the discharging route, the sheet is guided from the upstream side toward the downstream side of the nip portion Np along the discharging rib portions eg1 and the discharging route ribs 48 between the switching ribs 47 and the rear wall portion 59*r* of the first frame member 59. Further, when the guiding route is switched to the post processing route, the sheet is guided near the upper frame UF along the post processing rib portions eg2 and the post processing route ribs 49 between the switching ribs 47 and the rear wall portion 59*r* of the first frame member 59.

In the first embodiment, a torsion spring 50 is disposed as a first urging member on each of the rotation shafts sh2 of the second discharging guide 42. The torsion spring 50 has one end portion engaging with a specific portion of the second discharging guide 42, and the other portion engaging with a specific portion of each of the sidewall portions 59*s* and the first frame member 59. Accordingly, the torsion springs 50 generate a first urging force to urge the second discharging guide 42, so that the second discharging guide 42 is placed at the medium discharging guiding position.

In the first embodiment, the second discharging guide 42 further includes a receiving member 53 for receiving the second lever of the second solenoid 92 (refer to FIG. 4). The receiving member 53 is disposed on one of the rotation shafts sh2 (the rotation shaft sh2 on the left side in FIG. 9) outside a width of the sheet having a largest size, that is, a maximum medium width, and is arranged to be freely rotatable relative to the second discharging guide 42 in a vertical direction. Further, a holding member 153 is disposed below the receiving member 53 by a specific distance. The holding member 153 is arranged not to be freely rotatable relative to the second discharging guide 42 in the vertical direction (is fixed to the second discharging guide 42).

In the first embodiment, the second discharging guide 42 further includes a compression spring 54 disposed as a second urging member between the receiving member 53 and the holding member 153 to be freely extendable. The compression spring 54 has one end portion (an upper end portion) fixed to a lower surface of the receiving member 53, and the other portion (a lower end portion) fixed to an upper surface of the holding member 153. Accordingly, the compression spring 54 generates a second urging force to urge the second solenoid 92 and the receiving member 53 upwardly. It is configured such that the second urging force generated with the compression spring 54 becomes greater than the first urging force generated with the torsion spring 50. It should be noted that the second discharging guide 42 also includes a groove portion and the like for guiding the receiving member 53.

In the first embodiment, the receiving member 53 includes a receiving surface 53*a* at an upper portion thereof, so that the second lever of the second solenoid 92 abuts against the receiving surface 53*a*. Accordingly, when the second solenoid 92 is driven, the second lever is moved forward downwardly. Further, the receiving member 53 is moved toward the holding member 153 against the second urging force generated with the compression spring 54. Accordingly, the holding member 153 is pushed downwardly. As a result, the second discharging guide 42 is rotated around the rotation shafts sh2 against the first urging force generated with the torsion spring 50, so that the second discharging guide 42 is situated at the medium post processing guiding position.

On the other hand, when the second solenoid 92 stops being driven, the second lever is moved backward and upwardly. Further, the receiving member 53 is moved away from the holding member 153 with the second urging force generated with the compression spring 54. Accordingly, the holding member 153 is no longer pushed downwardly. As a result, the second discharging guide 42 is rotated around the rotation shafts sh2 with the first urging force generated with the torsion spring 50, so that the second discharging guide 42 is situated at the medium discharging guiding position.

A configuration of a rotation restriction unit will be explained next. The rotation restriction unit is provided for stopping the second discharging guide 42 at a specific position in a rotational direction thereof when the second discharging guide 42 is situated at the medium discharging guiding position, so that the rotation restriction unit restricts the second discharging guide 42 not to rotate further.

In the first embodiment, the rotation restriction unit includes a hooking member 56 as an engaging element or a first engaging portion and a stopper 60 as an engaged element or a second engaging portion. The hooking member 56 is disposed on the second discharging guide 42 on the downstream side from the nip portion Np in the transportation direction of the sheet. Further, the hooking member 56 is formed at a specific location on the upper edge of the second discharging guide 42 in the longitudinal direction thereof, that is, a substantially central location in the first embodiment. Further, the hooking member 56 is formed to protrude toward the first discharging outlet h1. The stopper 60 is disposed on the first frame member 59, that is, on the inner circumferential surface of the top wall portion 59*t* of the first frame member 59 at a location corresponding to the hooking member 56. Further, the stopper 60 is formed to protrude toward the hooking member 56. It should be noted that the substantially central location may be defined as a location from the one end portion of the second discharging guide 42 within a range between 40% and 60% in the longitudinal direction of the second discharging guide 42.

In the first embodiment, a portion of the second discharging guide 42 other than the hooking member 56, that is, a main body portion of the second discharging guide 42 or a discharging guide main body, constitutes a medium guiding portion Q. It should be noted that the hooking member 56 is integrally formed with the medium guiding portion Q. Further, the medium guiding portion Q is formed of a resin material, and the hooking member 56 and the stopper 60 are formed of a metal material.

In the first embodiment, the hooking member 56 includes a base portion 156 fixed to the second discharging guide 42 with a screw bt1 as a first fixing element; a rising portion 157 formed to rise from an end portion of the base portion 156 on a side of the stopper 60 in the right angle direction; and a distal end portion 158 formed on an upper edge of the rising portion 157 to protrude toward the stopper 60 in a direction perpendicular to the rising portion 157 and in parallel to the base portion 156. The distal end portion 158 is formed in a T-character shape. Further, the distal end portion 158 includes a central portion ct having a width the same as that of the rising portion 147, and a first arm portion am1 and a second arm portion am2 formed to protrude from the central portion ct in the left and right direction, respectively.

In the first embodiment, the stopper 60 includes a base portion 160 fixed to the top wall portion 59*t* of the first frame member 59 with a screw bt2 as a second fixing element to abut against the inner circumferential surface of the top wall portion 59*t*; a dropping portion 161 formed to extend downwardly from an end portion of the base portion 160 on a side of the hooking member 56 in the right angle direction relative to the base portion 160; and a distal end portion 162 formed on a lower edge of the dropping portion 161 to protrude toward the hooking member 56 in a direction perpendicular to the dropping portion 161 and in parallel to the base portion 160. The distal end portion 162 is formed in a U-character shape, and includes a groove portion m1 for accommodating the rising portion 157 of the hooking member 56. Further, the distal end portion 162 includes a first arm portion am11 and a second arm portion am12 formed on each of both sides of the groove portion m1 to protrude toward the hooking member 56, respectively.

In the first embodiment, engaging pieces k1 to k3 for positioning are formed on an edge portion of the base portion 160 on the side of the first discharging outlet h1, and left and right edge portions of the base portion 160. The engaging pieces k1 to k3 are provided for engaging with engaging holes q1 to q3 formed in the top wall portion 59*t* of the first frame member 59. Accordingly, it is possible to position the stopper 60 relative to the first frame member 59, and to stably attach the stopper 60 to the first frame member 59.

In the first embodiment, a first restricted portion is formed of a lower surface of the distal end portion 158 of the hooking member 56 in the upper and lower direction, that is, a hooking member lower surface Sd. Further, a second restricted portion is formed of a surface of the distal end portion 158 facing the stopper 60, that is, a hooking member side surface Sf. Further, a first restricting portion is formed of an upper surface of the distal end portion 162 of the stopper 60 in the upper and lower direction, that is, a stopper upper surface Su. Further, a second restricting portion is formed of a surface of the dropping portion 161 of the stopper 60 facing the hooking member 56, that is, a stopper side surface Sr.

In the first embodiment, the hooking member 56 and the stopper 60 are arranged such that the hooking member 56 engages with the stopper 60 at the central location in the direction substantially perpendicular to the transportation direction of the sheet, that is, in the longitudinal direction of the second discharging guide 42. Alternatively, the hooking member 56 and the stopper 60 may be arranged such that the hooking member 56 engages with the stopper 60 within a region where the sheet is transported in the longitudinal direction of the second discharging guide 42. Further, the hooking member 56 and the stopper 60 are arranged such that the hooking member 56 engages with the stopper 60 at one location in the longitudinal direction of the second discharging guide 42. Alternatively, the hooking member 56 and the stopper 60 may be arranged such that the hooking member 56 engages with the stopper 60 at a plurality of locations.

Figure 1:
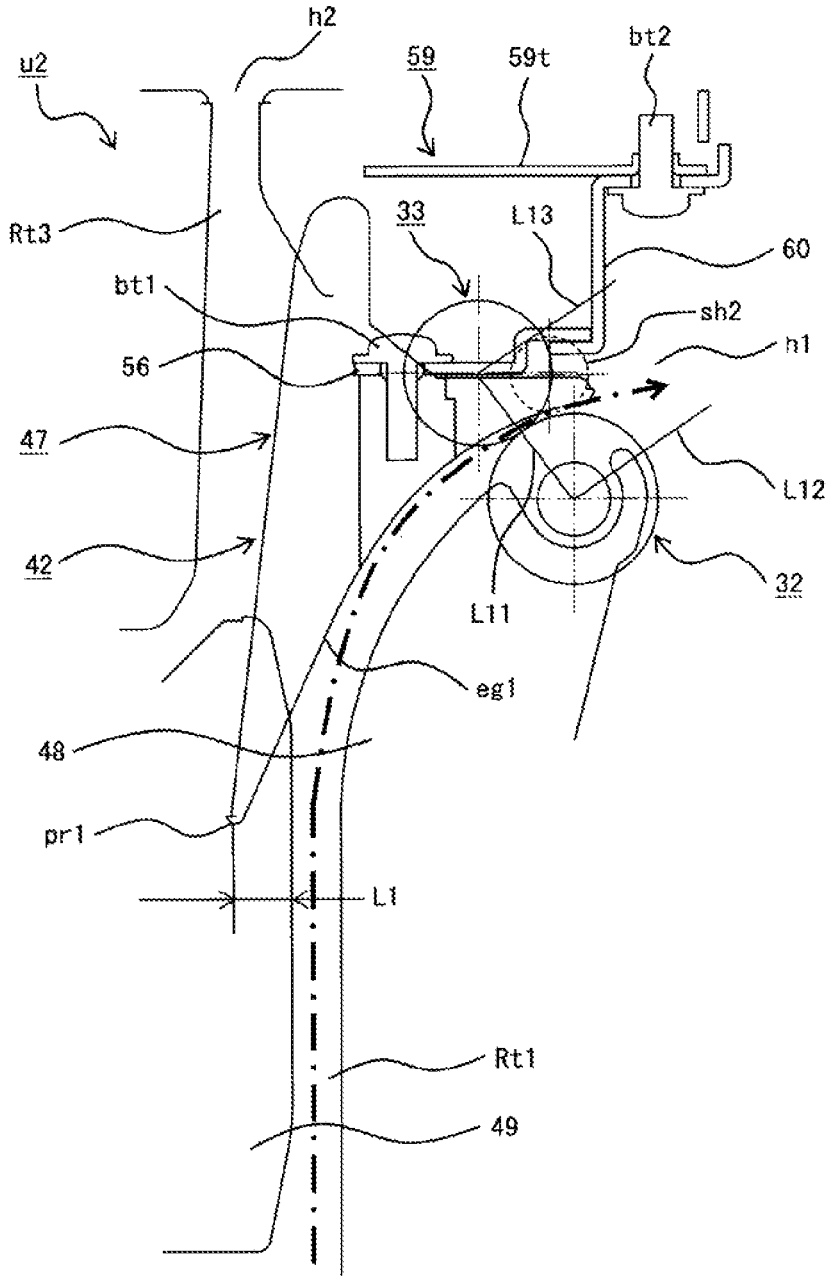
FIG. 1 is a schematic sectional view No. 1 showing an operation of a medium discharging unit of a printer when a discharging route is set according to a first embodiment of the present invention.
Figure 16:
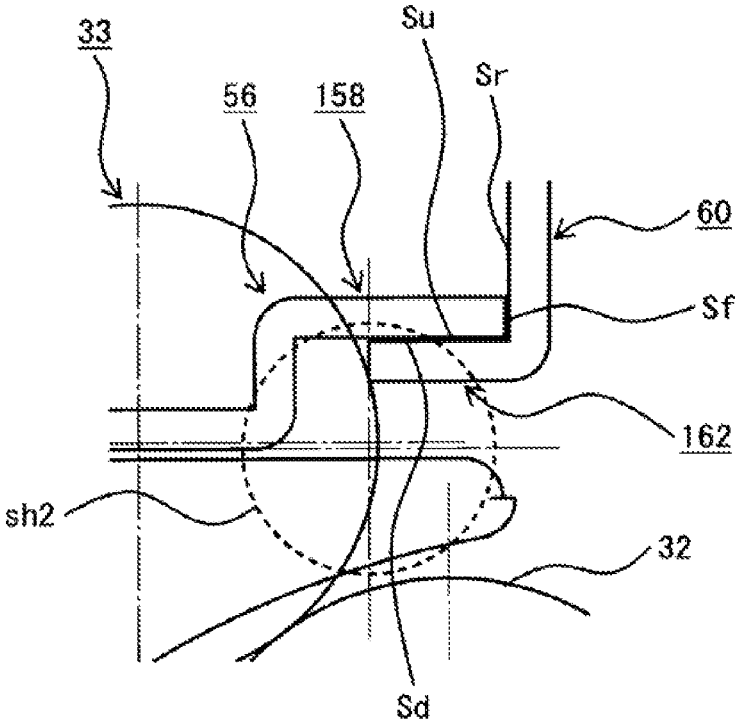
FIG. 16 is a schematic sectional view No. 1 showing a state of a rotation restriction unit of the medium discharging unit of the printer when the discharging route is set according to the first embodiment of the present invention.
Figure 17:
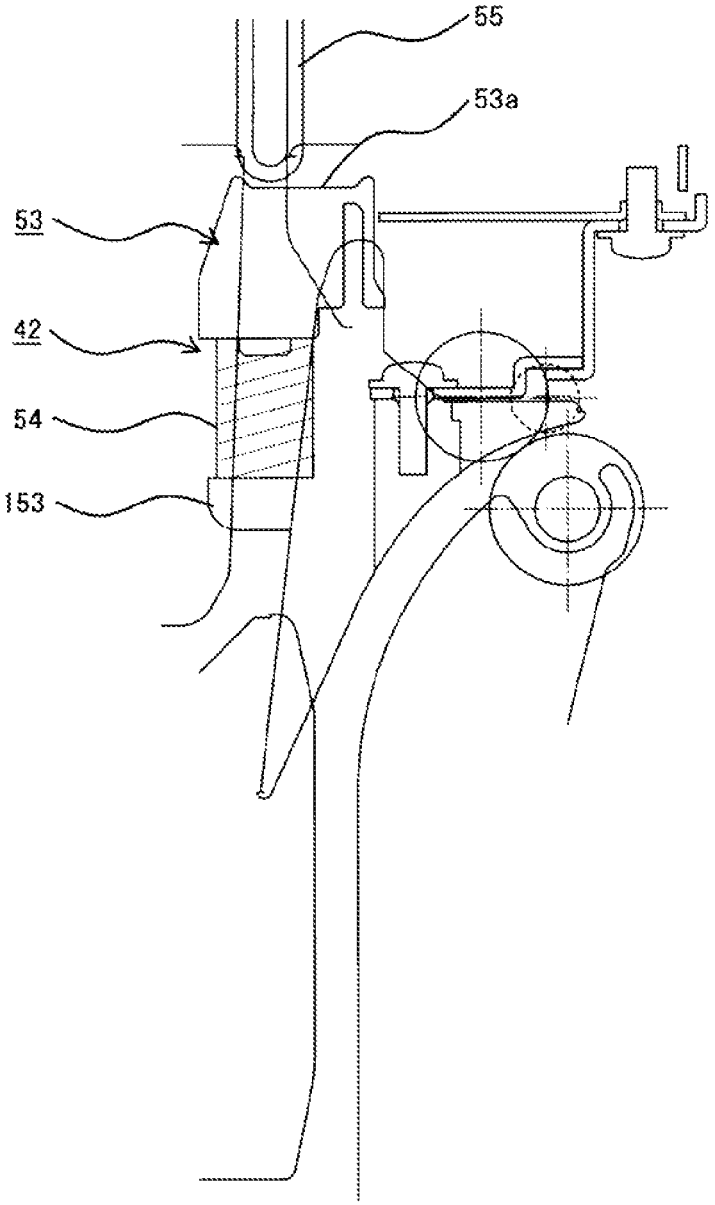
FIG. 17 is a schematic sectional view No. 2 showing the operation of the medium discharging unit of the printer when the discharging route is set according to the first embodiment of the present invention.

An operation of the medium discharging unit u2 will be explained next. FIG. 1 is a schematic sectional view No. 1 showing an operation of the medium discharging unit u2 of the printer 11 when the discharging route is set according to the first embodiment of the present invention. FIG. 16 is a schematic sectional view No. 1 showing a state of the rotation restriction unit of the medium discharging unit u2 of the printer 11 when the discharging route is set according to the first embodiment of the present invention. FIG. 17 is a schematic sectional view No. 2 showing the operation of the medium discharging unit u2 of the printer 11 when the discharging route is set according to the first embodiment of the present invention.

Figure 18:
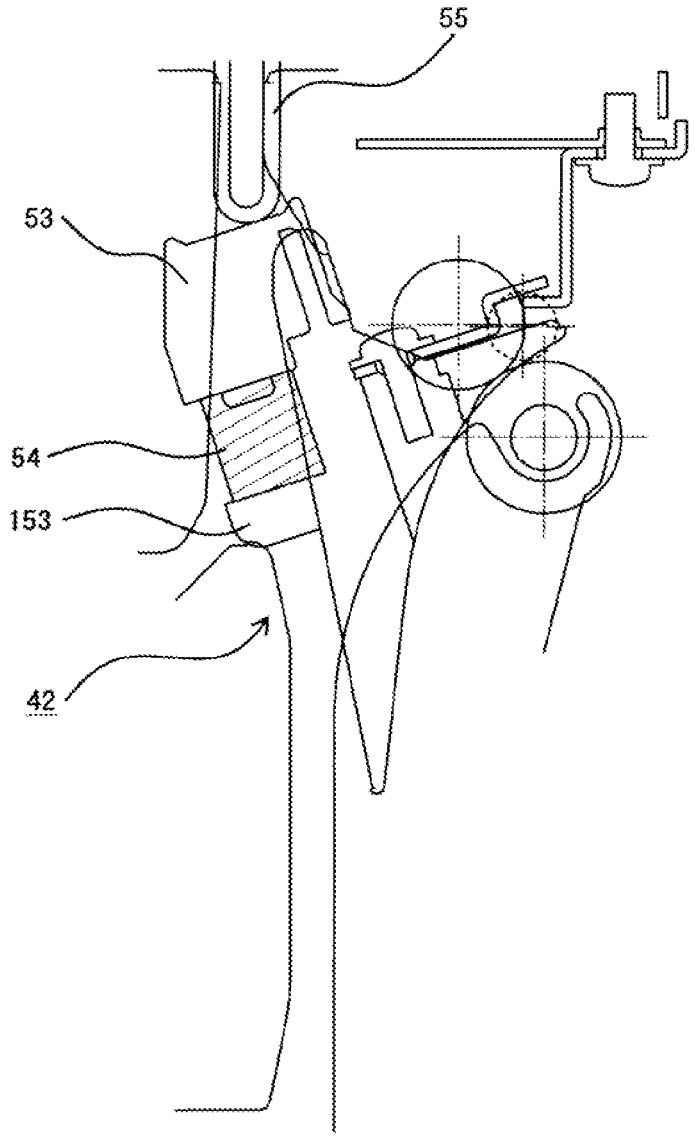
FIG. 18 is a schematic sectional view No. 3 showing the operation of the medium discharging unit of the printer when the discharging route is set according to the first embodiment of the present invention.
Figure 19:
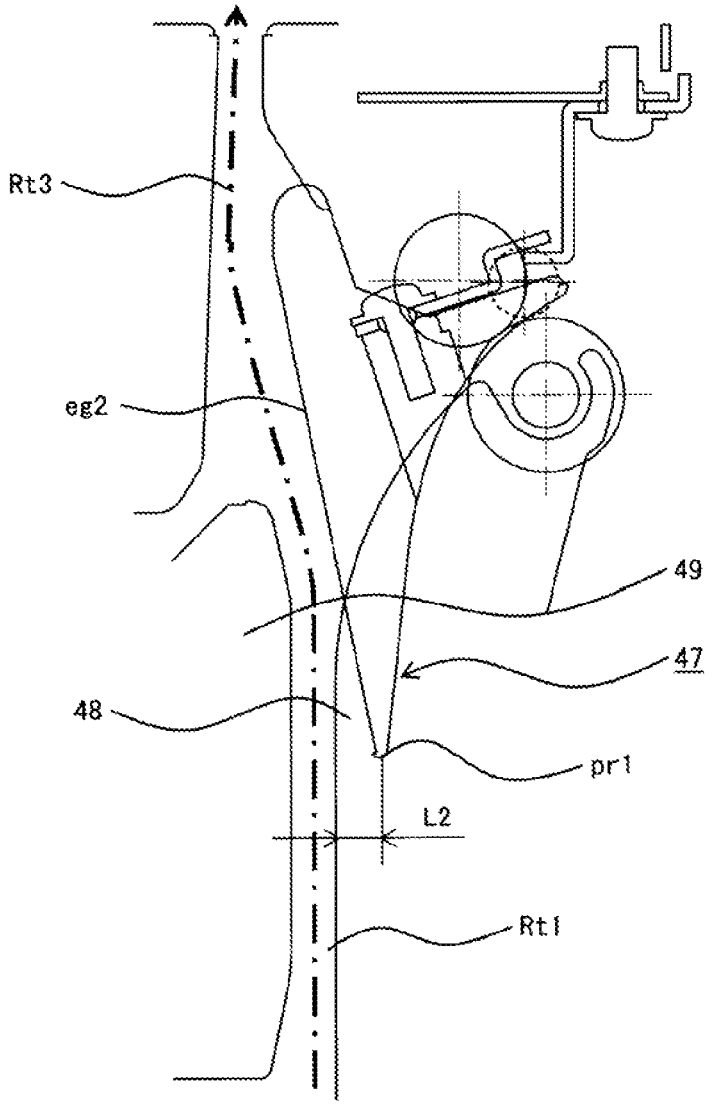
FIG. 19 is a schematic sectional view No. 4 showing the operation of the medium discharging unit of the printer when the discharging route is set according to the first embodiment of the present invention.
Figure 20:
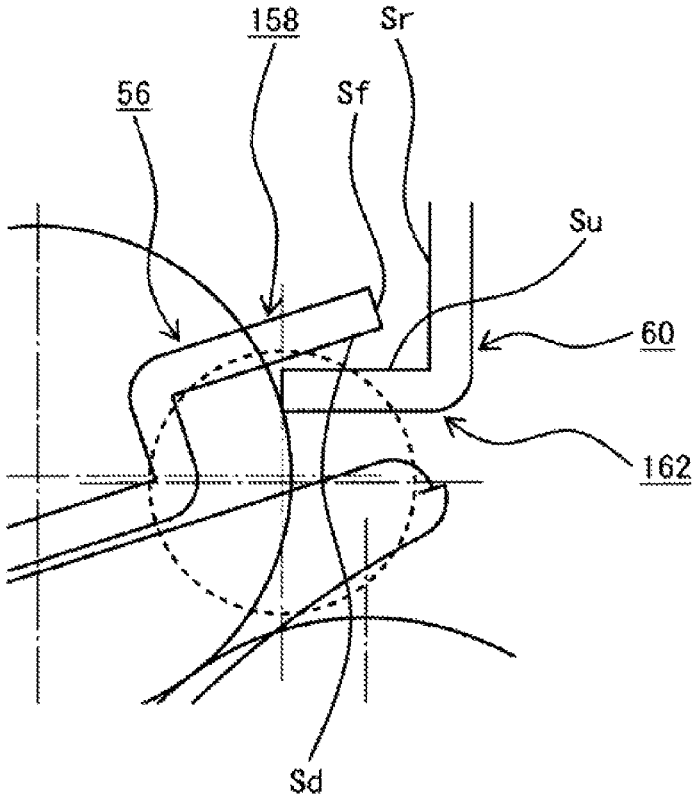
FIG. 20 is a schematic sectional view No. 2 showing the state of the rotation restriction unit of the medium discharging unit of the printer when the discharging route is set according to the first embodiment of the present invention.

FIG. 18 is a schematic sectional view No. 3 showing the operation of the medium discharging unit u2 of the printer 11 when the discharging route is set according to the first embodiment of the present invention. FIG. 19 is a schematic sectional view No. 4 showing the operation of the medium discharging unit u2 of the printer 11 when the discharging route is set according to the first embodiment of the present invention. FIG. 20 is a schematic sectional view No. 2 showing the state of the rotation restriction unit of the medium discharging unit u2 of the printer 11 when the discharging route is set according to the first embodiment of the present invention.

As described above and shown in FIG. 1, the printer 11 includes the medium discharging unit u2; the medium transportation path Rt1; the medium transportation path Rt3; the first discharging outlet h1; the second discharging outlet h2; the screws bt1 and bt2; the discharging roller 32; the discharging roller 33; the second discharging guide 42; the switching ribs 47; the rotation shafts sh2 of the second discharging guide 42; the post processing route ribs 49; the receiving member 53; the compression spring 54; the holding member 153; the hooking member 56; the first frame member 59; and the stopper 60.

First, the operation of the medium discharging unit u2 when the sheet fed from the first discharging guide 41 (refer to FIG. 2) is discharged outside the apparatus main body through the first discharging outlet h1 will be explained.

In the first embodiment, when the image forming control unit 61 receives the instruction from the host computer to discharge the sheet outside the apparatus main body through the first discharging outlet h1 after the image is formed on the sheet, the image forming control unit 61 instructs the discharging guide control unit 90 to stop driving the second solenoid 92 (refer to FIG. 4).

At this moment, in the second discharging guide 42, the receiving surface 53*a* of the receiving member 53 abuts against a second lever 55 of the second solenoid 92. When the discharging guide control unit 90 stops driving the second solenoid 92, the second lever 55 is stopped in the retracted state. Accordingly, the second discharging guide 42 is situated at the medium discharging guiding position as shown in FIG. 1 through the urging force of the torsion spring 50 (refer to FIG. 7) disposed on the rotation shaft sh2 of the second discharging guide 42.

In the first embodiment, at this moment, a specific overlap L1 is generated with the distal end portions pr1 of the switching ribs 47 and the post processing route ribs 49, so that the medium transportation path Rt1 and the medium transportation path Rt3 are closed. Accordingly, the discharging route formed of the medium transportation path Rt1 is set between the discharging rob portions eg1 of the switching ribs 47 and the discharging route ribs 48.

Further, as shown in FIG. 16, the hooking member 56 engages with the stopper 60 at the distal end portion 158 of the hooking member 56 and the distal end portion 162 of the stopper 60. When the hooking member lower surface Sd abuts against the stopper upper surface Su, the hooking member 56 is restricted from moving in a first direction, that is, downwardly in the vertical direction in the first embodiment. Further, the hooking member 56 is restricted from moving a second direction different from the first direction (substantially perpendicular to the first direction), that is, toward the first discharging outlet h1 in the horizontal direction.

In the first embodiment, as described above, the specific overlap L1 is generated with the pointy end portions pr1 of the switching ribs 47 and the post processing route ribs 49. Accordingly, the leading edge of the sheet transported from the first discharging guide 41 abuts against the discharging rib portions eg1 of the switching ribs 47, so that the sheet is guided with the discharging rib portions eg1 and the discharging route ribs 48. As a result, it is possible to prevent the sheet from jamming, and to smoothly transport and discharge the sheet outside the apparatus main body.

Further, in the first embodiment, the hooking member 56 is restricted from moving downwardly in the vertical direction, and from moving toward the first discharging outlet h1 in the horizontal direction. Accordingly, it is possible to prevent the discharging rib portions eg1 of the switching ribs 47 from excessively being close to the discharging route ribs 48 near the nip portion Np (refer to FIG. 21) of the discharging roller 32 and the discharging roller 33. As a result, even when the second discharging guide 42 is deformed due to heat of the fixing device 28 (refer to FIG. 2), a force applied externally, and the like, it is possible to prevent the medium transportation path Rt1 from being narrowed. Accordingly, it is possible to prevent the sheet discharged from the first discharging outlet h1 from being winkled, or from being damaged.

Further, in the first embodiment, the hooking member 56 engages with the stopper 60 near a portion of restricting the transportation of the sheet such as the nip portion Np of the discharging roller 32 and the discharging roller 33. Accordingly, the hooking member 56 is restricted from moving, and the second discharging guide 42 is restricted from moving. As a result, it is possible to smoothly transport the sheet along the second discharging guide 42.

Further, in the first embodiment, the hooking member 56 is restricted from moving downwardly in the vertical direction, and from moving toward the first discharging outlet h1 in the horizontal direction. Accordingly, it is possible to restrict the second discharging guide 42 from moving with high accuracy, and to improve the transportation ability of the sheet with the second discharging guide 42. Further, the hooking member 56 is restricted from moving in the two directions substantially perpendicular to each other. Accordingly, it is possible to restrict the second discharging guide 42 from moving with further high accuracy.

Further, in the first embodiment, the hooking member 56 engages with the stopper 60 on the downstream side from the nip portion Np in the transportation direction of the sheet, and substantially at the central location of the second discharging guide 42 in the longitudinal direction thereof. Accordingly, it is possible to accurately position the second discharging guide 42 relative to the first frame member 59 while restricting the hooking member 56 from moving. Accordingly, it is possible to accurately guide the sheet with the second discharging guide 42, thereby further improving the transportation ability of the sheet.

In the first embodiment, as shown in FIG. 1, a first imaginary line L11 passes through each of the rotational axes of the discharging roller 32 and the discharging roller 33; a second imaginary line L12 passes through the rotational axis of the discharging roller 32 and extends in a direction substantially perpendicular to the first imaginary line L11 toward the downstream side in the transportation direction of the sheet; and a third imaginary line L13 passes through the rotational axis of the discharging roller 33 and extends in a direction substantially perpendicular to the first imaginary line L11 toward the downstream side in the transportation direction of the sheet. With the configuration, the hooking member 56 engages with the stopper 60 between the second imaginary line L12 and the third imaginary line L13. Accordingly, it is possible to restrict the hooking member 56 from moving near the medium transportation path Rt1, thereby further improving the transportation ability of the sheet with the second discharging guide 42.

Next, the operation of the medium discharging unit u2 when the sheet fed from the first discharging guide 41 is discharged to the post processing device through the second discharging outlet h2 will be explained.

As shown in FIG. 17, the receiving member 53 is disposed on the second discharging guide 42, so that the receiving surface 53*a* of the receiving member 53 abuts against the second lever 55 of the second solenoid 92. When the image forming control unit 61 receives the instruction from the host computer to discharge the sheet to the post processing device through the second discharging outlet h2, the image forming control unit 61 instructs the discharging guide control unit 90 to stop driving the second solenoid 92.

As shown in FIG. 18, when the second solenoid 92 is driven, the second lever 55 is moved forward, and the receiving member 53 is moved toward the holding member 153 against the urging force of the compression spring 54. Accordingly, the holding member 153 is pushed downwardly. As a result, the second discharging guide 42 is placed at the medium post processing guiding position against the urging force of the torsion spring 50 (refer to FIG. 7).

Further, as shown in FIG. 20, when the second discharging guide 42 is rotated, the hooking member 56 is inclined, so that the hooking member 56 is disengaged from the stopper 60 at the distal end portion 158 of the hooking member 56 and the distal end portion 162 of the stopper 60. Accordingly, the hooking member lower surface Sd is separated from the stopper upper surface Su, and the hooking member side surface Sf is separated from the stopper side surface Sr.

At this moment, as shown in FIG. 19, a specific overlap L2 is generated with the distal end portions pr1 of the switching ribs 47 and the discharging route ribs 48, so that the medium transportation path Rt1 and the medium transportation path Rt3 are opened. Accordingly, the post processing route formed of the medium transportation path Rt3 is set between the switching ribs 47 and the discharging route ribs 48.

In this case, if the second lever 55 is moved downwardly excessively upon driving the second solenoid 92, the second discharging guide 42 may contact with a part of the second frame member 159, thereby restricting the second discharging guide 42 from rotating. However, in the first embodiment, the compression spring 54 is disposed to urge the receiving member 53 upwardly with the urging force greater than the urging force of the torsion spring 50. Accordingly, it is possible to prevent the second lever 55 from being moved downwardly excessively.

In the first embodiment, as described above, the specific overlap L2 is generated with the pointy end portions pr1 of the switching ribs 47 and the post processing route ribs 49. Accordingly, the leading edge of the sheet transported from the first discharging guide 41 abuts against the post processing rib portions eg2 of the switching ribs 47, so that the sheet is guided with the post processing rib portions eg2 and the post processing route ribs 49. As a result, it is possible to prevent the sheet from jamming, and to smoothly transport and discharge the sheet to the post processing device.

In the first embodiment, it should be noted that the discharging roller 32 and the discharging roller 33 are disposed in the medium transportation path Rt1, and are not disposed in the medium transportation path Rt3. Accordingly, when the second discharging guide 42 is placed at the medium post processing guiding position, even if the second discharging guide 42 is deformed and the post processing rout formed of the medium transportation path Rt3 is narrowed, it is possible to smoothly transport the sheet.

On the other hand, when the second discharging guide 42 is placed at the medium post processing guiding position, if the second discharging guide 42 is deformed and the post processing rout formed of the medium transportation path Rt1 is narrowed, it is difficult to smoothly transport the sheet.

To this end, in the first embodiment, when the second discharging guide 42 is placed at the medium post processing guiding position, the hooking member 56 is disengaged from the stopper 60 at the distal end portion 158 of the hooking member 56 and the distal end portion 162 of the stopper 60. As described above, when the second discharging guide 42 is placed at the medium discharging guiding position, the hooking member 56 engages with the stopper 60 at the distal end portion 158 of the hooking member 56 and the distal end portion 162 of the stopper 60. Accordingly, the hooking member 56 is restricted from moving downwardly in the vertical direction and toward the first discharging outlet h1 in the horizontal direction.

Second Embodiment

Figure 21:
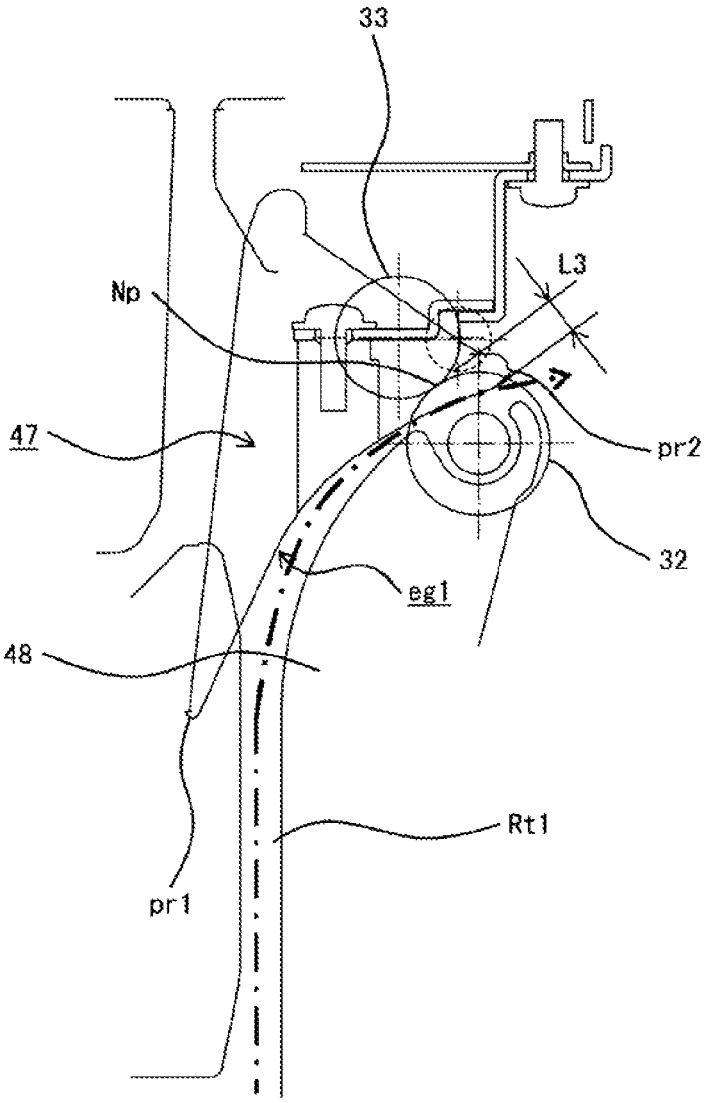
FIG. 21 is a schematic sectional view showing an operation of a medium discharging unit of a printer when a discharging route is set according to a second embodiment of the present invention.

A second embodiment of the present invention will be explained next. FIG. 21 is a schematic sectional view showing an operation of the medium discharging unit u2 of the printer 11 when the discharging route is set according to a second embodiment of the present invention.

In the first embodiment, when the color image is formed on the sheet, toner is heated and permeates into the sheet in the fixing device 28. Accordingly, when the toner images in colors are fixed to the sheet, the sheet may be curled in the transportation direction thereof.

To this end, in the second embodiment, as shown in FIG. 21, the discharging rib portions eg1 are formed in a specific shape such that the pointy end portions pr1 of the switching ribs 47 and the opposite end portions pr2 at the opposite side are shifted from the nip portion Np of the discharging roller 32 and the discharging roller 33 by a distance L3 toward the discharging route ribs 48 when the second discharging guide 42 is situated at the medium discharging guiding position. Accordingly, it is possible to impart rigidity to the sheet, thereby preventing the sheet from being curled.

In the second embodiment, the hooking member 56 engages with the stopper 60, so that the hooking member 56 is restricted from moving downwardly and toward the first discharging outlet h1. Accordingly, it is possible to prevent the distance L3 from becoming excessively large when the second discharging guide 42 is rotated. As a result, it is possible to prevent the sheet from being winkled upon being discharged from the first discharging outlet h1, or from being damaged.

In the first embodiment and the second embodiment, the hooking member 56 and the stopper 60 are disposed substantially at the central location of the second discharging guide 42 in the longitudinal direction thereof. When the printer 11 is configured to perform the printing operation on a sheet having a large width, that is, a large sheet width, the hooking member 56 and the stopper 60 may be disposed at a plurality of locations in the longitudinal direction of the second discharging guide 42.

In the first embodiment and the second embodiment, the stopper 60 is formed separately from the first frame member 59, and is attached to the first frame member 59. Alternatively, the stopper 60 may be formed integrally with the first frame member 59.

Further, in the first embodiment and the second embodiment, the second discharging guide 42 is disposed in the medium transportation path Rt1. Alternatively, the second discharging guide 42 may be disposed in other medium transportation path.

In the first embodiment and the second embodiment, it is configured such that when the second solenoid 92 is driven or stops being driven, the second discharging guide 42 is switched. Alternatively, it may be configured such that a lever and the like is operated from the side of the post processing device to switch the second discharging guide 42.

Further, in the first embodiment and the second embodiment, the drive motors 77Bk, 77Y, 77M, and 77C are provided corresponding to the image forming units 12Bk, 12Y, 12M, and 12C, respectively. Alternatively, one single drive motor may be disposed and driven to rotate the photosensitive drums 13Bk, 13Y, 13M, and 13C of the image forming units 12Bk, 12Y, 12M, and 12C, and the like.

In the first embodiment and the second embodiment, the printer 11 includes the image forming units 12Bk, 12Y, 12M, and 12C for forming the color image. It should be noted that the present invention may be applicable to a printer having one single image forming unit for forming a monochrome image.

Further, in the first embodiment and the second embodiment, the present invention is applied to the printer 11. It should be noted that the present invention may be applicable to an image forming apparatus such as a copier, a facsimile, a multi function device, and the like.

It should be noted that the present invention is not limited to the embodiments described above. The present invention may be modified according to the concept thereof, and these modifications are still within the scope of the present invention.

The disclosure of Japanese Patent Application No. 2014-036493, filed on Feb. 27, 2014, is incorporated in the application.

While the invention has been explained with reference to the specific embodiments of the invention, the explanation is illustrative and the invention is limited only by the appended claims.

What is claimed is:

1. A medium transportation apparatus comprising:

a fixed member fixed to an apparatus main body; and a switching guide for guiding a medium, wherein said switching guide is disposed to be rotatable relative to the apparatus main body, and to be switched between a first guiding position and a second guiding position, said switching guide includes a medium guiding portion and a first engaging portion formed with the medium guiding portion, said fixed member includes a second engaging portion engaging with the first engaging portion when the switching guide is situated at the first guiding position, and said second engaging portion includes a first restriction portion for restricting the first engaging portion from moving in a first direction, and a second restriction portion for restricting the first engaging portion from moving in a second direction different from the first direction.

2. The medium transportation apparatus according to claim 1, wherein said second restriction portion is arranged to restrict the first engaging portion from moving in the second direction substantially perpendicular to the first direction.

3. The medium transportation apparatus according to claim 1, further comprising a first roller and a second roller arranged to abut against the first roller at an abutting portion, wherein said switching guide is arranged to guide the sheet from an upstream side toward a downstream side of the abutting portion in a transportation direction of the medium, and said second engaging portion is arranged to engage with the first engaging portion on the downstream side from the abutting portion in the transportation direction of the medium.

4. The medium transportation apparatus according to claim 1, further comprising a first roller pair formed of a first roller and a second roller, and a second roller pair formed of a third roller and a fourth roller, wherein said first roller pair and said second roller pair are arranged in a direction substantially perpendicular to the transportation direction of the medium with a specific distance in between, and said second engaging portion is arranged to engage with the first engaging portion at a location between the first roller pair and the second roller pair.

5. The medium transportation apparatus according to claim 1, wherein said medium guiding portion is formed of a resin material, and said first engaging portion and said second engaging portion are formed of a metal material.

6. The medium transportation apparatus according to claim 1, further comprising:

a first urging member for generating a first urging force to place the switching guide at the first guiding position; and a second urging member disposed between the switching guide and a driving portion for driving the switching guide to the first guiding position, wherein said second urging member is arranged to generate a second urging force toward the driving portion, and said second urging member is arranged to generate the second urging force greater than the first urging force.

7. An image forming apparatus comprising the medium transportation apparatus according to claim 1.

8. The medium transportation apparatus according to claim 1, further comprising a first roller for transporting the medium and a second roller arranged to abut against the first roller at an abutting portion for transporting the medium together with the first roller, wherein said switching guide is arranged to guide the sheet from an upstream side toward a downstream side of the abutting portion in a transportation direction of the medium.

9. The medium transportation apparatus according to claim 8, wherein said first roller and said second roller are arranged so that a first imaginary line passes through rotation axes of the first roller and the second roller; a second imaginary line passes through the rotation axis of the first roller and extends toward the downstream side in the transportation direction of the sheet in a direction substantially perpendicular to the first imaginary line; and a third imaginary line passes through the rotation axis of the second roller and extends toward the downstream side in the transportation direction of the sheet in a direction substantially perpendicular to the first imaginary line, and said second engaging portion is arranged to engage with the first engaging portion at a location between the second imaginary line and the third imaginary line.

10. The medium transportation apparatus according to claim 8, further comprising a first roller and a second roller arranged to abut against the first roller at an abutting portion, wherein said switching guide is arranged to guide the sheet from an upstream side toward a downstream side of the abutting portion in a transportation direction of the medium, and said second engaging portion is arranged to engage with the first engaging portion on the downstream side from the abutting portion in the transportation direction of the medium.

11. The medium transportation apparatus according to claim 10, further comprising a stacker for placing the medium, wherein said first roller and said second roller are arranged to discharge the medium toward the stacker.

12. The medium transportation apparatus according to claim 8, further comprising a stacker for placing the medium, wherein said first roller and said second roller are arranged to discharge the medium toward the stacker.

13. A medium transportation apparatus comprising:

a fixed member fixed to an apparatus main body; and a switching guide for guiding a medium, wherein said switching guide is disposed to be rotatable relative to the apparatus main body, and to be switched between a first guiding position and a second guiding position, said switching guide includes a medium guiding portion and a first engaging portion formed with the medium guiding portion, said fixed member includes a second engaging portion engaging with the first engaging portion when the switching guide is situated at the first guiding position, and in a direction substantially perpendicular to a transportation direction of the medium, said second engaging portion is arranged to engage with the first engaging portion within a region where the medium is transported.

14. The medium transportation apparatus according to claim 13, wherein said second engaging portion is arranged to engage with the first engaging portion at a substantially central location of the medium guiding portion in a direction substantially perpendicular to a transportation direction of the medium.

15. The medium transportation apparatus according to claim 13, wherein said second engaging portion is arranged to engage with the first engaging portion at a plurality of locations of the medium guiding portion in a direction substantially perpendicular to a transportation direction of the medium.

16. The medium transportation apparatus according to claim 13, further comprising a first roller pair and a second roller pair, wherein said first roller pair and said second roller pair are arranged in a direction substantially perpendicular to the transportation direction of the medium with a specific distance in between, and said second engaging portion is arranged to engage with the first engaging portion at a location between the first roller pair and the second roller pair.

17. The medium transportation apparatus according to claim 16, further comprising a stacker for placing the medium, wherein said first roller pair is arranged to discharge the medium toward the stacker.

18. An image forming apparatus comprising the medium transportation apparatus according to claim 13.

19. The medium transportation apparatus according to claim 13, wherein said medium guiding portion is formed of a resin material, and said first engaging portion and said second engaging portion are formed of a metal material.

* * * * *